US006873903B2

(12) United States Patent
Baiada et al.

(10) Patent No.: US 6,873,903 B2
(45) Date of Patent: Mar. 29, 2005

(54) METHOD AND SYSTEM FOR TRACKING AND PREDICTION OF AIRCRAFT TRAJECTORIES

(76) Inventors: R. Michael Baiada, 30943 Buttermilk Ct., Evergreen, CO (US) 80439; Lonnie H. Bowlin, 700 Woodland Way, Owings, MD (US) 20736

( * ) Notice: Subject to any disclaimer, the term of this patent is extended or adjusted under 35 U.S.C. 154(b) by 137 days.

(21) Appl. No.: 10/238,032

(22) Filed: Sep. 6, 2002

(65) Prior Publication Data

US 2003/0050746 A1 Mar. 13, 2003

Related U.S. Application Data

(60) Provisional application No. 60/332,614, filed on Nov. 19, 2001, and provisional application No. 60/317,803, filed on Sep. 7, 2001.

(51) Int. Cl.[7] ..... G08B 23/00; G08G 5/04

(52) U.S. Cl. ..... 701/120; 701/5; 340/961; 342/455

(58) Field of Search ..... 701/120, 3, 5, 701/16, 301; 340/970, 961, 963; 342/455

(56) References Cited

U.S. PATENT DOCUMENTS

| | | | | |
|---|---|---|---|---|
| 4,196,474 A | | 4/1980 | Buchanan et al. | 364/461 |
| 5,200,901 A | | 4/1993 | Gerstenfeld | 364/439 |
| 5,321,605 A | | 6/1994 | Chapman et al. | 364/402 |
| 5,369,570 A | | 11/1994 | Parad | 364/401 |
| 5,798,712 A | * | 8/1998 | Coquin | 340/970 |
| 5,890,133 A | | 3/1999 | Ernst | 705/7 |
| 5,953,707 A | | 9/1999 | Huang et al. | 705/10 |
| 6,510,388 B1 | * | 1/2003 | Sporrong et al. | 701/301 |
| 6,690,296 B2 | * | 2/2004 | Corwin et al. | 340/961 |

FOREIGN PATENT DOCUMENTS

| | | |
|---|---|---|
| GB | 2327517 | 6/1997 |
| WO | WO0062234 | 10/2000 |

* cited by examiner

*Primary Examiner*—Thomas G. Black
*Assistant Examiner*—Arthur D. Donnelly
(74) *Attorney, Agent, or Firm*—Larry J. Guffey

(57) ABSTRACT

A method for predicting the trajectory of an aircraft is disclosed. It yields the arrival/departure times for a plurality of aircraft with respect to a specified system resource and is based upon specified data and other operational factors pertaining to the aircraft and system resource. This process comprises the steps of: (a) collecting and storing the specified data and operational factors, (b) processing, at an initial instant, the specified data that is applicable at that instant to the aircraft so as to predict an initial trajectory encompassing arrival/departure times for each aircraft, (c) upgrading these initial trajectory predictions for effects of: (1) environmental factors (weather, turbulence), (2) actions of the Air traffic Control system (e.g., stacking incoming aircraft when runway demand is greater than availability), and (3) secondary assets (e.g., crew availability/legality, gate availability, maintenance requirements), (d) communicating these trajectory predictions to interested parties and (e) continuously monitoring all trajectories, and, as necessary, updating the predictions.

21 Claims, 19 Drawing Sheets

FIG. 1 - Aircraft Flight Process
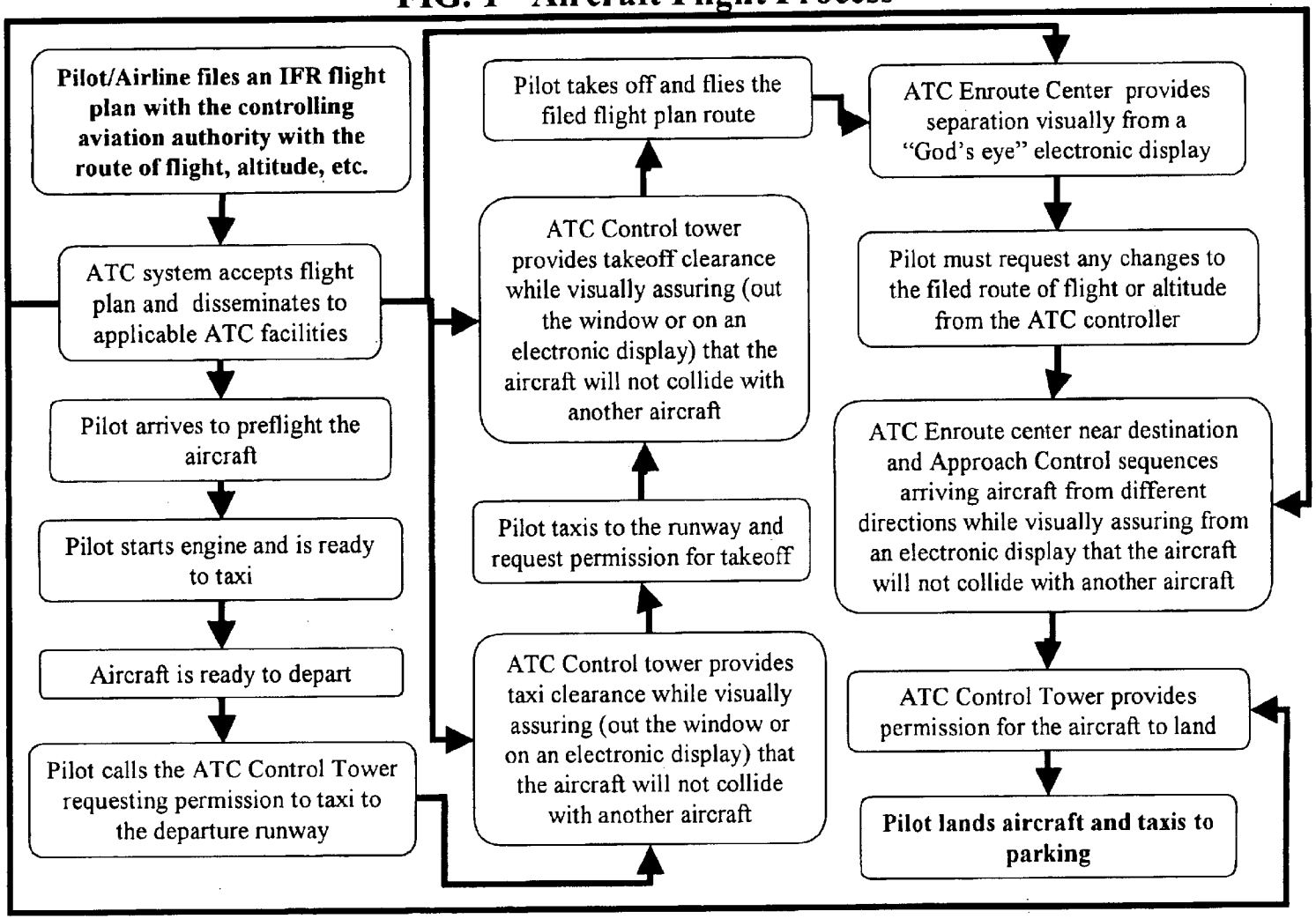

FIG. 2- Airport Arrival/Departure Flow
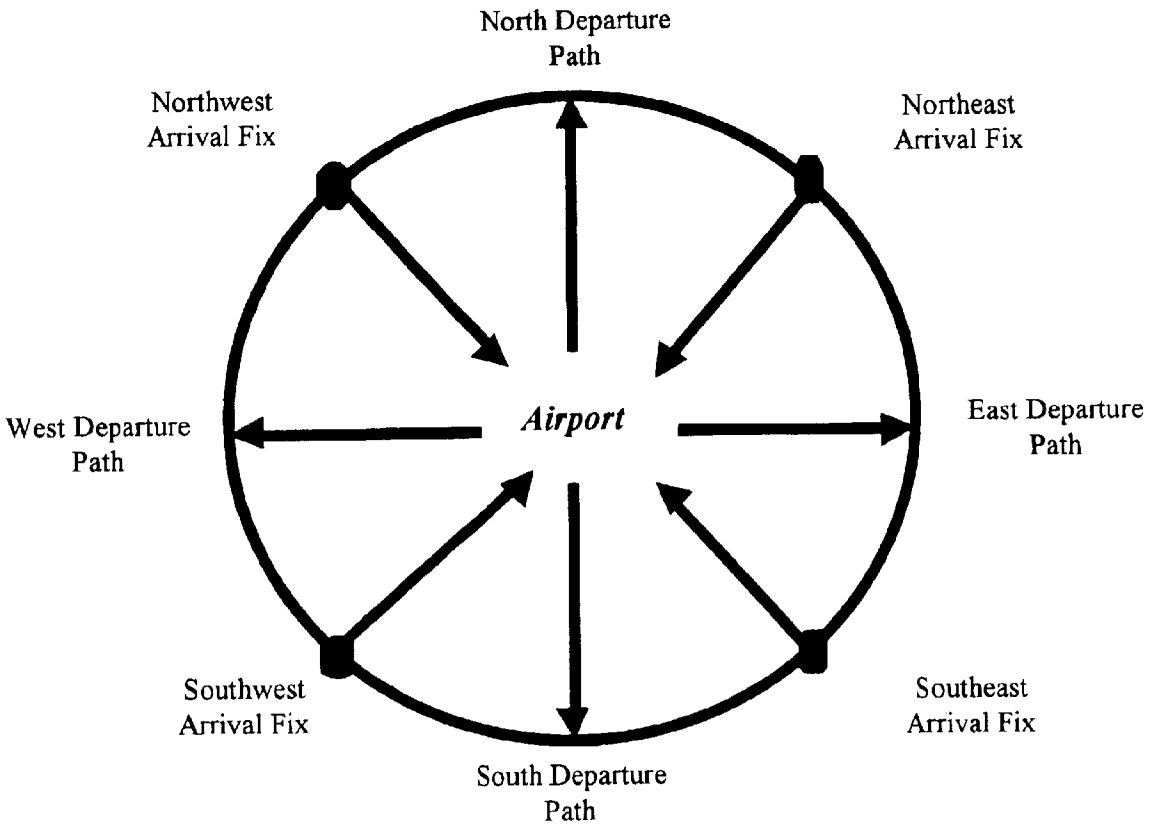

FIG. 3 - Typical Hub Arrival Schedules versus Capacity Shown In 15 Minute Blocks
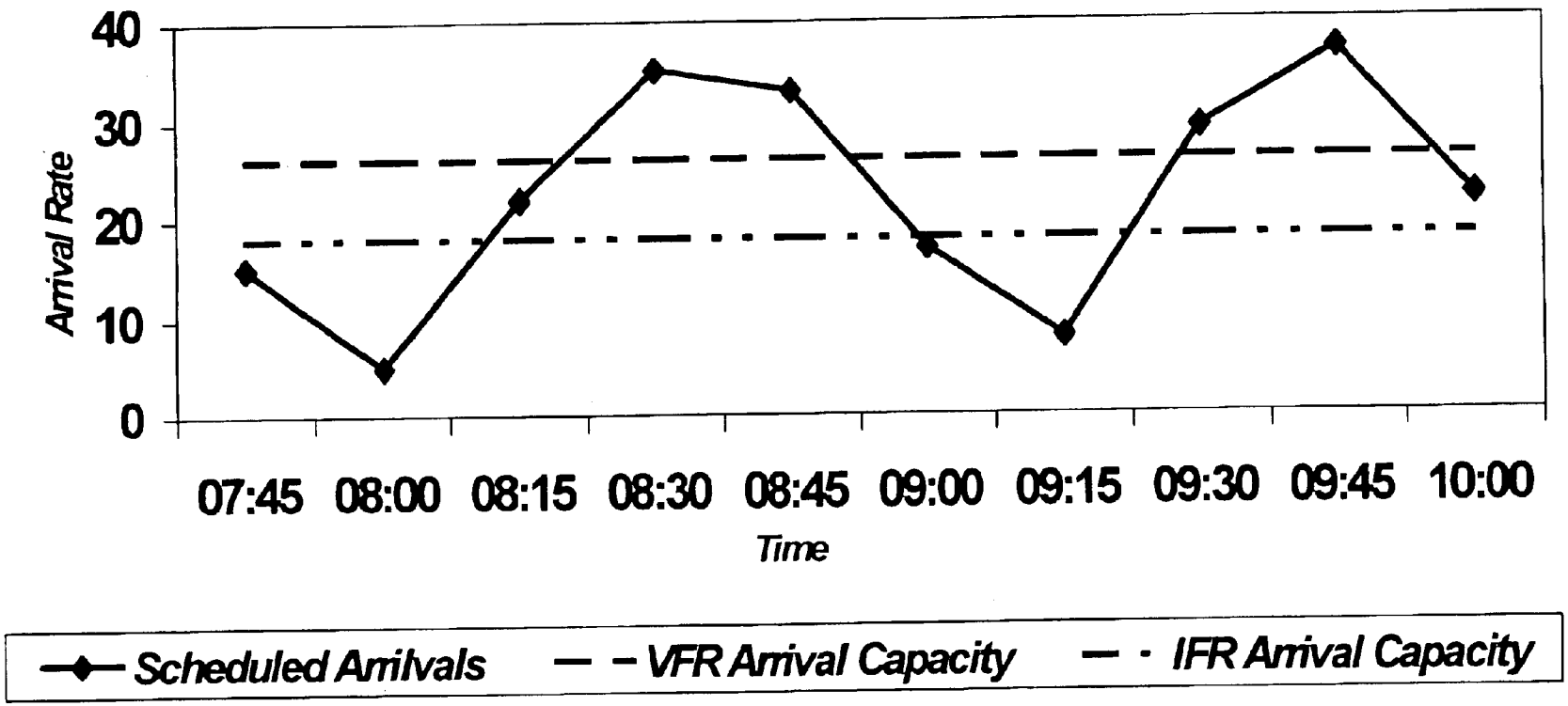

FIG. 4 – Typical Airline Production Process
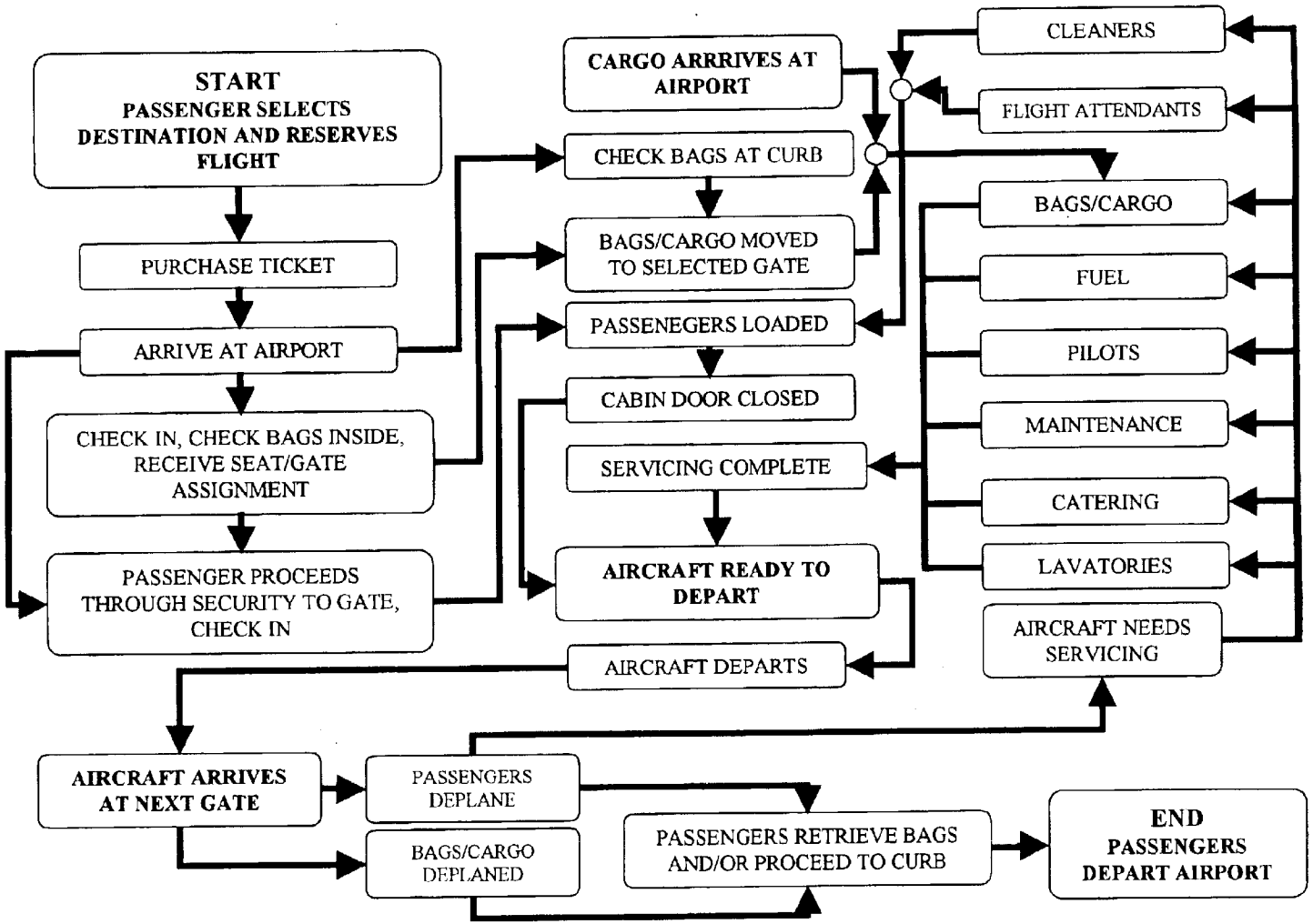

FIG. 5 - DFW CTAS Data, 2200 TO 2230 CMT Arrivals - 11/6/98

| | | | |
|---|---|---|---|
| 1. AAL458 | SJC | 18R | 2201 |
| 2. EGF026 | MEM | 17L | 2201 |
| 3. AAL1707 | TPA | 17C | 2201 |
| 4. EGF202 | SHV | 17L | 2202 |
| 5. EGF784 | ACT | 13R | 2202 |
| 6. TWA453 | STL | 18R | 2202 |
| 7. EGF736 | TUL | 17L | 2203 |
| 8. AAL1498 | SNA | 18R | 2203 |
| 9. AAL2038 | IAH | 17C | 2203 |
| 10.AAL79 | EGK | 17C | 2204 |
| 11.EGF650 | LIT | 17L | 2204 |
| 12.AWE544 | PHX | 18R | 2205 |
| 13.EGF854 | TYR | 17L | 2206 |
| 14.KHA200 | FTW | 13R | 2206 |
| 15.DAL237 | ATL | 18R | 2207 |
| 16.EGF094 | GGG | 17L | 2207 |
| 17.AAL1779 | LIT | 17C | 2207 |
| 18.EGF128 | TXK | 17C | 2208 |
| 19.EGF718 | MAF | 13R | 2208 |
| 20.AAL656 | ABQ | 18R | 2209 |
| 21.EGF114 | LCH | 17L | 2209 |
| 22.AAL2161 | EWR | 17C | 2209 |
| 23.EGF621 | HOU | 17L | 2210 |
| 24.EGF704 | XNA | 17C | 2210 |
| 25.AAL1188 | ONT | 13R | 2210 |
| 26.AAL50 | DEN | 18R | 2211 |
| 27.AAL1714 | LAS | 13R | 2212 |
| 28.AAL839 | MSY | 17C | 2213 |
| 29.AAL1412 | ELP | 18R | 2214 |
| 30.AAL1720 | OKC | 13R | 2214 |
| 31.AAL1306 | SLC | 13R | 2215 |
| 32.AAL2233 | ORD | 17C | 2216 |
| 33.COA186 | IAH | 18R | 2217 |
| 34.AAL1404 | COS | 17C | 2217 |
| 35.AAL742 | MCI | 13R | 2218 |
| 36.USA777 | PIT | 18R | 2218 |
| 37.AAL1016 | SAN | 17C | 2219 |
| 38.AAL1280 | LGB | 18R | 2219 |
| 39.AAL1884 | SAT | 17C | 2220 |
| 40.AAL794 | SEA | 13R | 2221 |
| 41.AMT255 | MDW | 18R | 2221 |
| 42.AAL48 | PHX | 13R | 2222 |
| 43.AAL564 | ICT | 17C | 2222 |
| 44.AAL496 | TUS | 18R | 2223 |
| 45.AAL9649 | MCO | 17C | 2223 |
| 46.AAL1552 | SFO | 18R | 2226 |
| 47.AAL1890 | LAX | 17C | 2226 |
| 48.UAL478 | SFO | 18R | 2228 |
| 49.UAL1055 | ORD | 18R | 2229 |
| 50.AAL1978 | AUS | 17C | 2230 |

FIG. 6 - December 2000 DOT Data

DECEMBER 2000 AIR TRAVEL CONSUMER REPORT
TABLE 3. PERCENTAGE OF ALL CARRIERS' REPORTED FLIGHT OPERATIONS ARRIVING ON TIME BY AIRPORT AND TIME OF DAY (REPORTABLE AIRPORTS ONLY)

| ARRIVAL AIRPORT SCHEDULED ARRIVAL TIME | ATL | BOS | BWI | CLT | CVG | DCA | DEN | DFW | DTW | EWR | IAH | JFK | LAS |
|---|---|---|---|---|---|---|---|---|---|---|---|---|---|
| 600 - 659 AM | 80.4 | 72.7 | 71.0 | 91.3 | 66.7 | 50.0 | 72.4 | 75.1 | 63.7 | 71.0 | 90.4 | 72.8 | 90.7 |
| 700 - 759 AM | 71.5 | 71.1 | 84.0 | 81.5 | 68.6 | 70.8 | 71.9 | 80.5 | 68.6 | 72.0 | 84.6 | 65.6 | 92.3 |
| 800 - 859 AM | 62.7 | 68.3 | 84.6 | 71.7 | 75.7 | 81.5 | 74.5 | 68.3 | 64.1 | 73.3 | 80.2 | 80.6 | 76.7 |
| 1000 - 1059 AM | 60.4 | 67.9 | 75.5 | 66.1 | 73.8 | 68.6 | 65.1 | 72.1 | 67.0 | 74.0 | 77.4 | 78.0 | 61.3 |
| 1100 - 1159 AM | 61.3 | 70.0 | 78.7 | 75.1 | 59.7 | 71.8 | 72.7 | 70.5 | 63.7 | 72.7 | 70.6 | J/ | 68.1 |
| 1200 - 1259 PM | 60.3 | 68.9 | 79.2 | 65.2 | 61.3 | 68.0 | 62.7 | 71.9 | 66.7 | 67.8 | 82.5 | J/ | 64.0 |
| 100 - 159 PM | 52.9 | 70.2 | 68.5 | 75.0 | 73.3 | 71.4 | 62.8 | 74.3 | 59.6 | 66.8 | 75.2 | 72.9 | 63.9 |
| 200 - 259 PM | 56.6 | 67.6 | 71.2 | 70.5 | 71.0 | 71.7 | 68.4 | 63.6 | 55.4 | 67.3 | 74.4 | 67.6 | 65.1 |
| 300 - 359 PM | 55.5 | 62.1 | 69.4 | 67.1 | 65.2 | 76.3 | 67.5 | 70.9 | 59.1 | 67.6 | 72.2 | 76.6 | 65.7 |
| 400 - 459 PM | 54.0 | 65.9 | 68.2 | 64.7 | 58.0 | 69.6 | 58.3 | 68.4 | 60.3 | 66.2 | 74.6 | 69.9 | 61.6 |
| 500 - 559 PM | 50.6 | 60.4 | 68.1 | 71.7 | 60.5 | 63.0 | 62.7 | 57.4 | 56.0 | 60.3 | 69.1 | 71.6 | 55.9 |
| 600 - 659 PM | 52.8 | 60.4 | 65.4 | 63.5 | 60.2 | 65.9 | 53.6 | 62.6 | 54.0 | 61.1 | 69.1 | 59.2 | 63.6 |
| 700 - 759 PM | 44.7 | 64.7 | 59.6 | 66.5 | 59.9 | 67.4 | 54.3 | 66.2 | 56.6 | 63.1 | 74.0 | 58.2 | 57.2 |
| 800 - 859 PM | 49.3 | 60.0 | 58.5 | 58.1 | 56.7 | 68.9 | 61.6 | 55.5 | 49.7 | 65.5 | 67.1 | 59.6 | 57.8 |
| 900 - 959 PM | 48.7 | 59.6 | 65.4 | 71.3 | 61.9 | 60.0 | 61.9 | 62.9 | 60.3 | 66.3 | 64.7 | 68.9 | 60.1 |
| 1000 - 1059 PM | 53.8 | 63.0 | 63.4 | 50.0 | 38.3 | 68.1 | 59.5 | 57.1 | 53.9 | 60.8 | 54.9 | 64.9 | 60.9 |
| 1100 - 559 AM | 57.7 | 62.1 | 63.7 | 65.7 | 55.7 | 55.4 | 59.9 | 65.5 | 56.9 | 70.7 | 62.8 | 68.1 | 61.9 |
| TOTAL by Airport | 56.9 | 65.0 | 69.8 | 70.1 | 64.5 | 69.1 | 64.1 | 67.1 | 59.9 | 67.0 | 73.7 | 68.2 | 64.6 |

FIG. 7 - The Runway Arrival Trombone
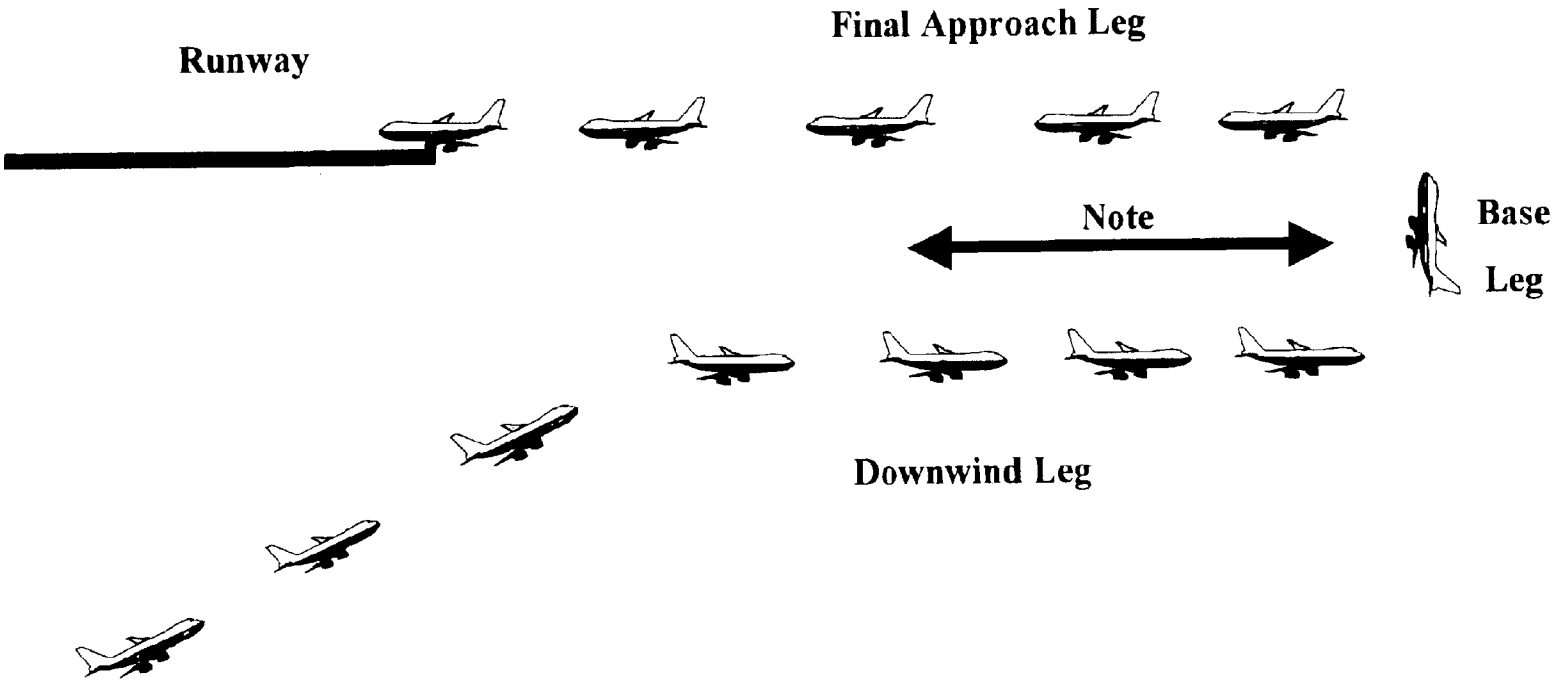
Note - Additional aircraft are warehoused by extending the distance from the base leg to the runway (i.e., extending the trombone), which lengthens the downwind and final approach segments of the approach allowing space for the extra aircraft.

FIG. 8 - Miles-In-Trail
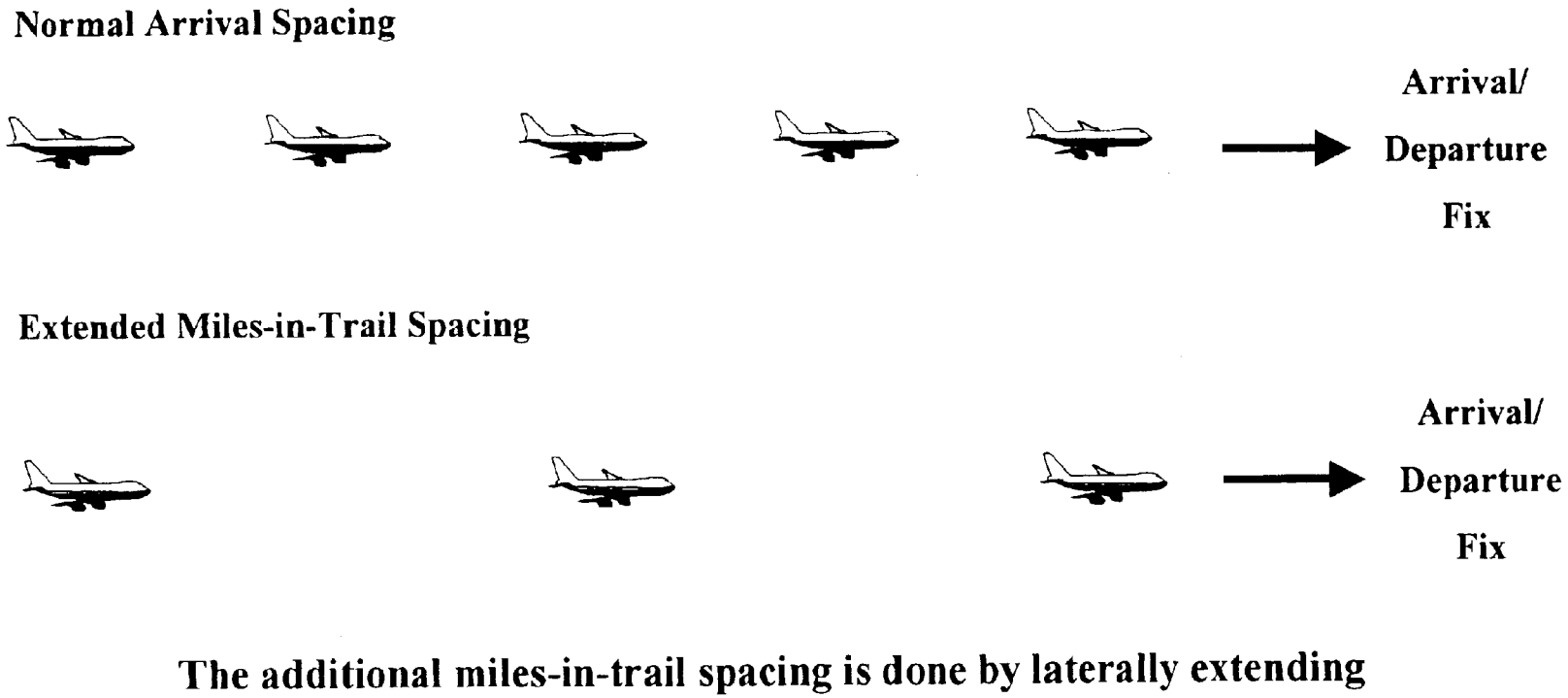
The additional miles-in-trail spacing is done by laterally extending the route or turning the aircraft.

FIG. 9 - Airborne Holding
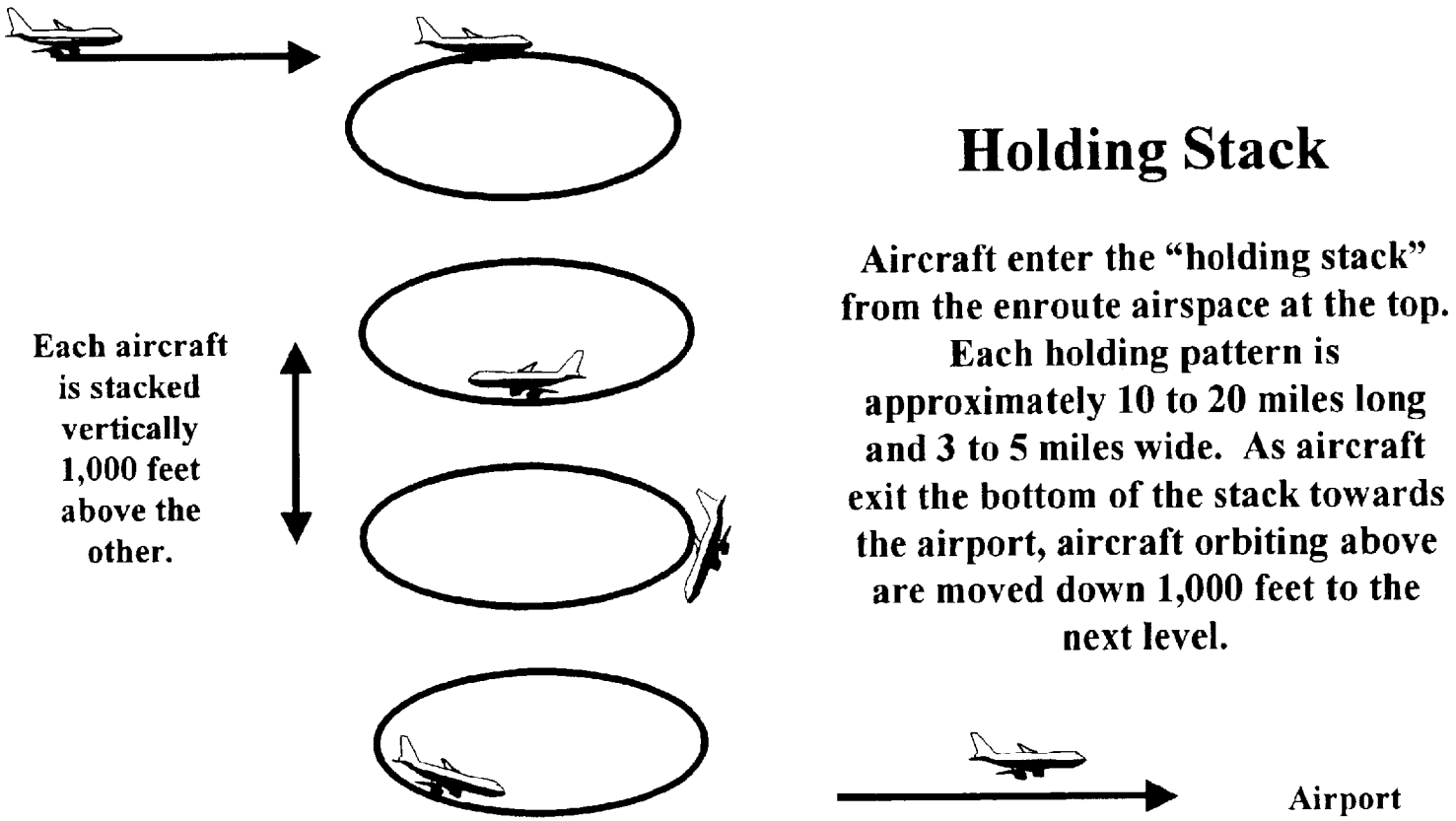

FIG. 10 - Methods of the Present Invention
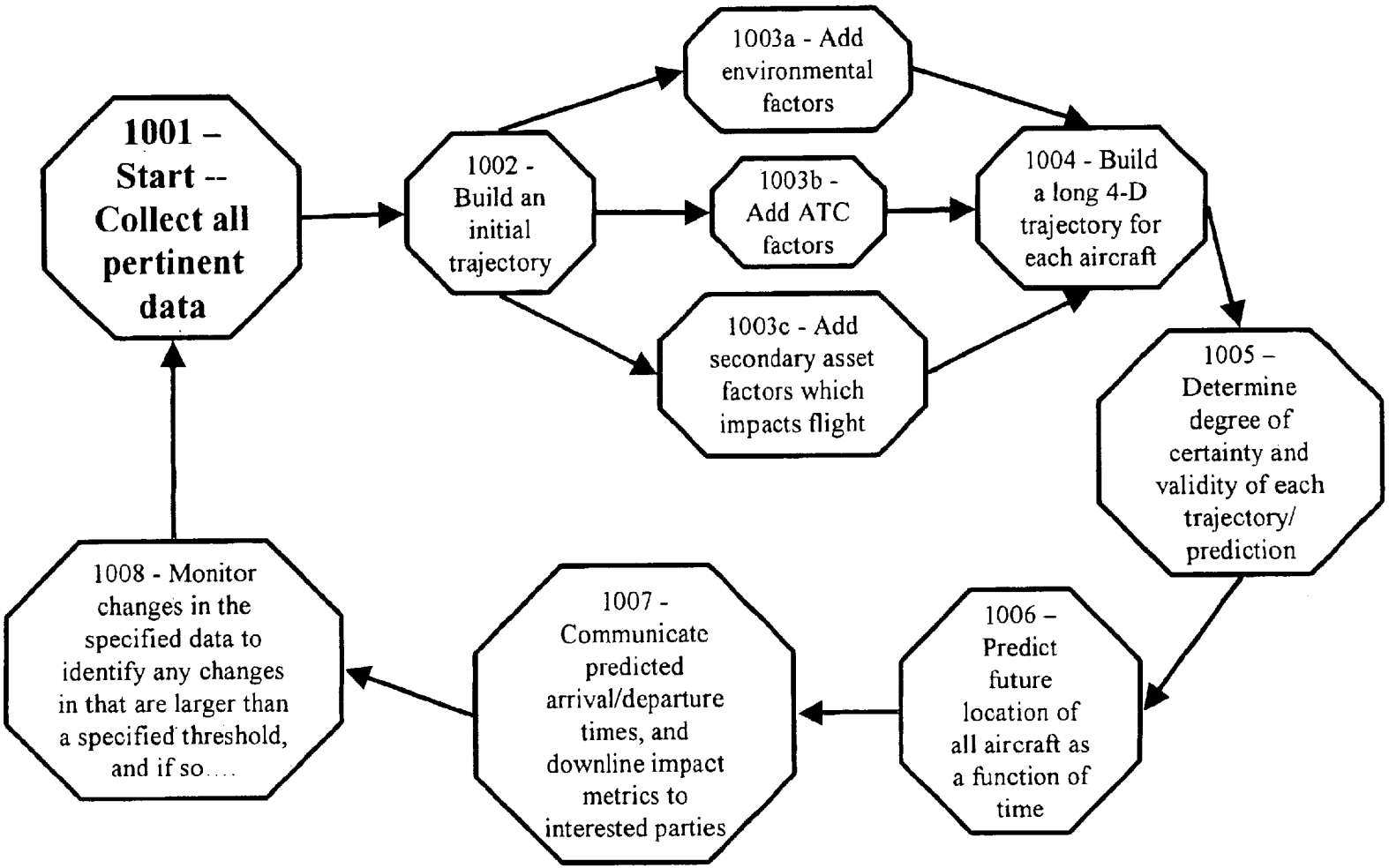

Fig 11a – Trajectory Prediction Parameter Matrix

Critical Factors:

1. What is the airport arrival time for each aircraft as determined by the airline/user/pilot?
2. What environmental factors will effect the aircraft trajectory?
3. What can the individual airlines do to meet the needs of all of the aircraft approaching the airport?
4. Is the airspace infrastructure (runways, airspace, arrival fix) capable of meeting the aircraft needs taking into account available assets and the needs of all of the other aircraft?
5. What time are the trajectories communicated to interested parties? [Note: the degree of certainty of the future trajectory prediction, i.e., Figure of Merit, is an important aspect of this decision]
6. Parameters 1 and 2 are determined by the user and passed to the Aviation Authority (if this is the operator) for integration to the present invention. Absence any information to from the airline/user/pilot, the present invention uses all available information.

FIG. 11b - Trajectory Prediction Parameter Matrix

Parameter 1 - Intra-Aircraft Parameters

Focus - Aircraft and User Needs and Wants

What does the individual aircraft need and/or want?

Arrival at airport at OAG Scheduled Arrival Time
Evaluate future trajectories for needs (Look Ahead)
Enough airport Time to:
- Get Passengers off/on
- Get Baggage off/on
- Get Cargo off/on
- Complete Aircraft Servicing (lavs, food, etc.)
- Complete required maintenance items
- Depart on time for next segment Enough connection time for passengers Maintenance Actions
- Scheduled maintenance
- Unscheduled repairs
- Deicing
- Known repairs Shorter route
Comfortable ride
Use Minimum Fuel
A gate upon arrival
Crew (Pilots and Flight Attendants)

Key Questions

What services does aircraft need? Regular or special?
What time does aircraft want to arrive in a perfect world?

Aircraft Characteristics

Safe Speed Range
Fuel Burn Model (fuel available to make desired change)
Wind Model
Altitude Capability (aircraft weight)

Enroute Weather Model
Enroute Turbulence Model
Aircraft position data
Fuel Burn Model (minimum fuel usage)

FIG. 11c - Trajectory Prediction Parameter Matrix

Parameter 2 - Intra-Airline Parameters

Focus - Airline Capabilities to meet needs of all aircraft

Can the airline meet the aircraft's needs?

- Gate Availability
- Jetway or Stair Availability
- Baggage Crew Availability
- Fueling Availability
- Flow of Passenger Connecting Flights
- Mechanic Availability
- Dynamic Gate Management
- Asset Trajectory Matching
- Cleaning Crew Availability
- Agent Availability
- Galley Loading/Unloading
- Parts Availability

Key Questions

What is the airline's ability to meet the needs of all aircraft?
Will airline service capability delay aircraft?

Airline Data

- Airport data
- Fuel truck data
- Passenger data/model
- Mechanic data.
- Crew data
- Customer Service Agent data
- Galley data
- Aircraft parts data

FIG. 11d - Trajectory Prediction Parameter Matrix

Parameter 3 - Aviation Authority Parameters

Focus - Infrastructure Capabilities to meet needs of all aircraft

Can the infrastructure meet the aircraft's needs?

- Airspace Availability
- Arrival Fix Availability
- Weather
- Airline/pilot requirements (Decision 1 and 2 data if available)
- Runway Availability
- Infrastructure Trajectory Matching
- Demand

Key Questions

- What is the aviation authority's ability to meet needs of all aircraft?
- Will infrastructure constraints delay aircraft?

Infrastructure Data

- Runway Acceptance Rate
- Weather
- Cornerpost Acceptance Rate
- Equipment Status

FIG. 11e - Trajectory Prediction Parameter Matrix

Communication Action 1 - Airline/Aviation Authority

Focus - How and When to Communicate Prediction

Communication Actions

Determine Figure of Merit is at an acceptable level
Transmit predictions to interested parties

Key Questions

What time should communication action take place?

FIG. 12 - Data Sets
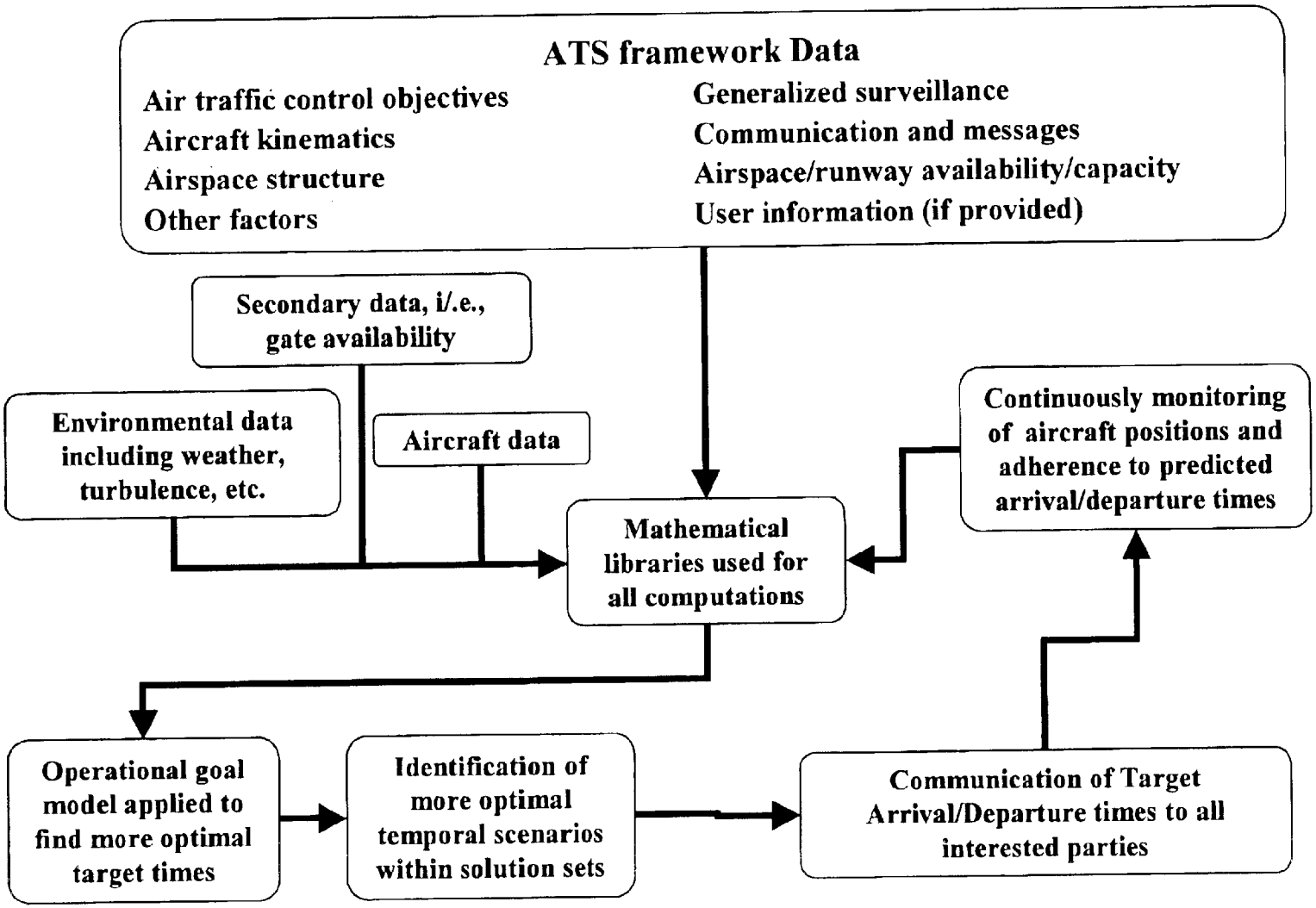

FIG. 13 - Random versus Time Sequenced Cornerpost Arrival Flow For the Same Set of Aircraft
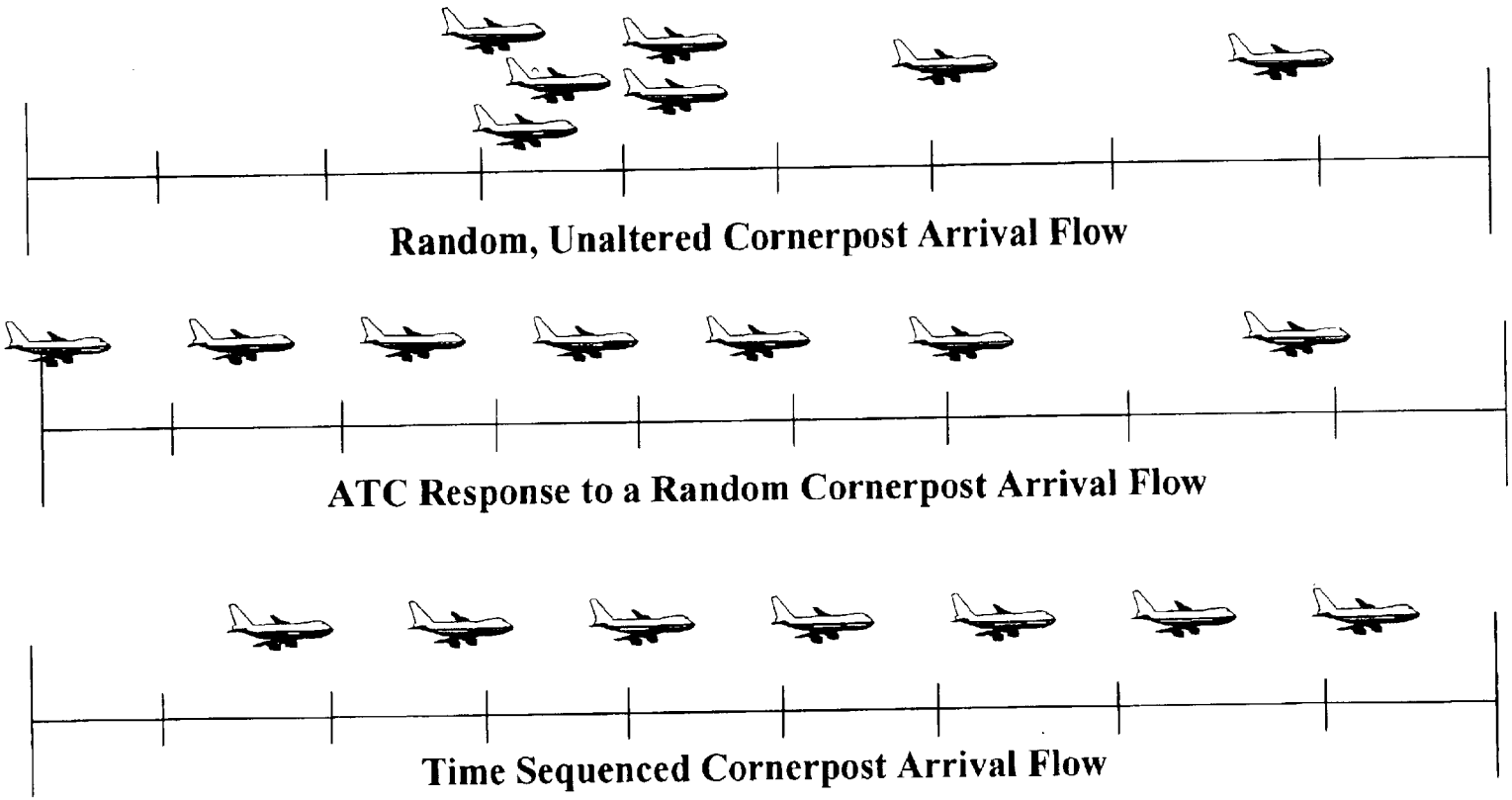

FIG. 14 - Typical Trajectory Building Process
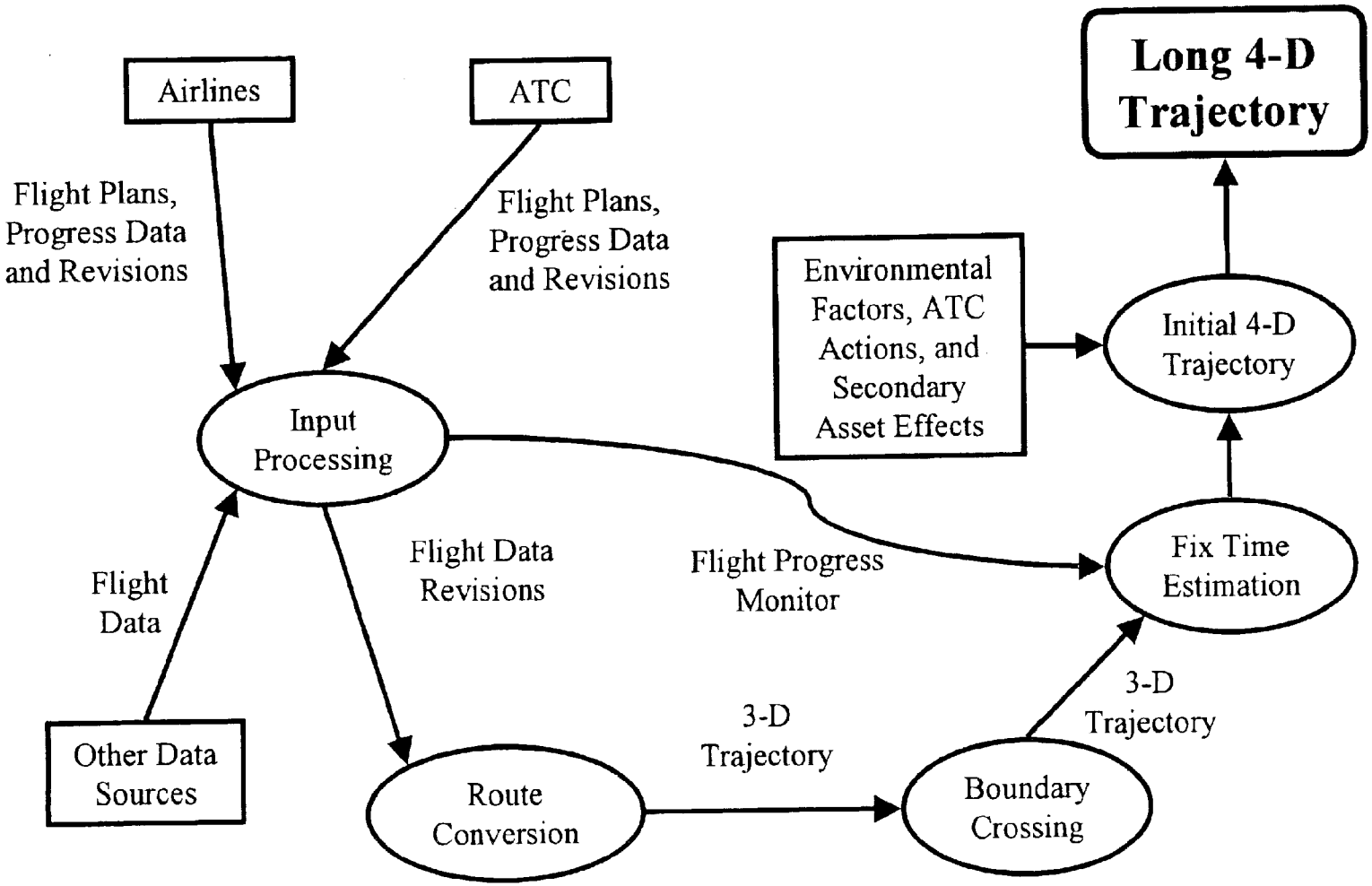

FIG. 15 - Long Trajectory Single Aircraft Trajectory Prediction
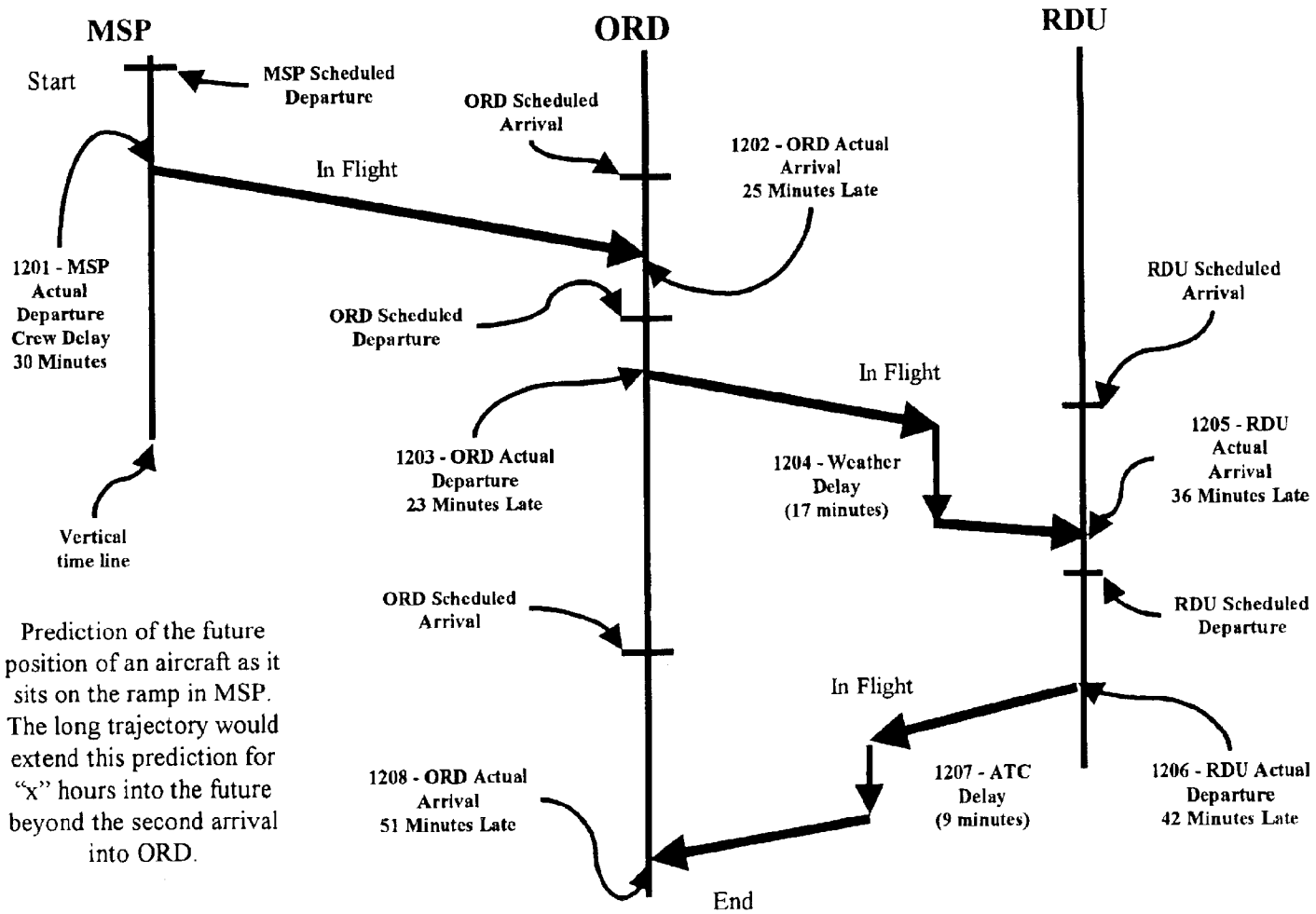

METHOD AND SYSTEM FOR TRACKING AND PREDICTION OF AIRCRAFT TRAJECTORIES

CROSS-REFERENCE TO RELATED APPLICATIONS

This application is related to the following U.S. Patent Applications: Provisional Application No. 60/332,614, filed Nov. 19, 2001 and entitled "Method And System For Allocating Aircraft Arrival/Departure Slot Times," Provisional Application No. 60/317,803, filed Sep. 7, 2001 and entitled "Method And System For Tracking and Prediction of Aircraft Arrival and Departure Times," Regular application Ser. No. 09/861,262, filed May 18, 2001 and entitled "Method And System For Aircraft Flow Management By Airlines/Aviation Authorities", Provisional Application No. 60/274,109, filed Mar. 8, 2001 and entitled "Method And System For Aircraft Flow Management By Aviation Authorities", Regular application Ser. No. 09/549,074, filed Apr. 16, 2000 and entitled "Method And System For Tactical Airline Management," Provisional Application No. 60/189,223, filed Mar. 14, 2000 and entitled "Tactical Airline Management," Provisional Application No. 60/173,049, filed Dec. 24, 1999 and entitled "Tactical Airline Management," and Provisional Application No. 60/129,563, filed Apr. 16, 1999 and entitled "Tactical Aircraft Management." All these applications having been submitted by the same applicants: R. Michael Baiada and Lonnie H. Bowlin. The teachings of these applications are incorporated herein by reference to the extent that they do not conflict with the teaching herein.

BACKGROUND OF THE INVENTION

1. Field of the Invention

The present invention relates to data processing and aircraft navigation. More particularly, this invention relates to methods and systems for airlines and others to better track and predict future aircraft trajectories so as to yield increased aviation safety and airline operating efficiency.

2. Description of the Related Art

Many complex methods for the tracking and prediction of material flows and the future position of particular assets as a function of time have been developed. However, as applied to the aviation industry, such methods often have been fragmentary and/or have not addressed the present and future movement of the aircraft and other aviation assets in relation to actions that can alter the aircraft's future trajectory.

Aviation regulatory authorities (e.g., various Civil Aviation Authorities (CAA) throughout the world, including the Federal Aviation Administration (FAA) within the U.S., are responsible for matters such as the separation of in-flight aircraft through an Air Traffic Control (ATC) system. In this task, the CAAs collect and disseminate considerable data concerning the location of aircraft within the airspace system. This data includes: radar data, verbal position reports, data link position reports (ADS), etc. Airlines and other aircraft operators have developed their own flight following systems as required by the world's CAAs, which provide additional information concerning the position and future path of the aircraft. Additionally, third parties have developed their own proprietary systems to track aircraft (e.g., Passur).

In the current art, the use of these data sources is done by various, independent agencies, airlines or third parties.

There appears to have been few successful attempts by the various airlines/CAAs/airports/third parties to develop accurate prediction process that encompass all of the real time events (weather, ATC, individual pilot decisions, secondary factors, maintenance requirements, turbulence, etc.) that can effect the trajectory of an aircraft. For example, in the tracking and prediction of an aircraft trajectory into an airport, it often happens that some critical elements are left out of the prediction that can have a significant impact on the accuracy of the predicted arrival/departure times.

An example of one of these elements is the ATC system's response to too many aircraft trying to land at an airport in a defined period of time. In the current art, the prediction of the aircraft trajectory encompassing the arrival/departure time is predicated on the current aircraft position, speed, flight path and possibly winds. Yet as the aircraft nears an overloaded airport, the ATC controller will often begin to slow down the aircraft to move it back in time.

This process is analogous to the "take a ticket and wait" approach used in other industries. To assure equitable service to all customers, as the consumer approaches a crowded counter, the vendor sets up a ticket dispenser with numbered tickets. On the wall behind the counter is a device displaying "Now Serving" and the number. This "first come, first serve" process assures that no one customer waits significantly longer than any other customer.

The effect of the ATC's "take a ticket and wait" solution on arrival/departure aircraft is to add 1, 5, 10, 15 or more minutes to the arrival/departure time. It is a goal of the present invention to encompass the effect of this "too many aircraft" and other factors in the development of more accurate, flight trajectory prediction methods.

Another aspect of the current art is the industry's use of single trajectory prediction methods. Those now doing aircraft trajectory predictions typically only look in detail at the current leg of an aircraft's flight schedule.

To better track and predict an aircraft trajectory encompassing the arrival/departure of an aircraft/aviation asset, it is first necessary to understand the aviation processes surrounding the flight of an aircraft. FIG. 1 has been provided to indicate the various segments in a typical aircraft flight process. It begins with the airline/pilot filing of an Instrument Flight Rules (IFR) flight plan with the applicable CAA. Next the pilot arrives at the airport, starts the engine, taxis, takes off, flies the flight plan (e.g., route of flight), lands and taxis to parking. At each stage during the movement of the aircraft on an IFR flight plan, the CAA's ATC system must approve any change to the trajectory of the aircraft. Further, anytime an aircraft on an IFR flight plan is moving, an ATC controller is responsible for maintaining adequate separation from other IFR aircraft.

During the last part of a flight, typical initial arrival sequencing (accomplished on a first come, first serve basis, e.g., the aircraft closest to the arrival airport is first, next closest is second and so on) is accomplished by the enroute ATC center near the arrival airport (within approximately 100 miles of the airport), refined by the arrival ATC facility (within approximately 25 miles of the arrival airport), and then approved for arrival by the ATC tower (within approximately 5 miles of the arrival/departure airport).

For example, current CAA practices for managing arrivals at many airports involve sequencing aircraft arrivals by linearizing an airport's traffic according to very structured, three-dimensional, aircraft arrival/departure paths, at a considerable distance from the airport. For a large hub airport (e.g., Chicago, Dallas, Atlanta), these paths involve specific geographic points that are separated by approximately ninety degrees; see FIG. 2. Further, if the traffic into an airport is relatively continuous over a period of time, the linearization of the aircraft flow is effectively completed hundreds of miles from landing. This can significantly restrict all the aircraft's arrival/departure speeds and alter the expected arrival/departure time, since all the aircraft in line are limited to that of the slowest aircraft in the line ahead, regardless of the aircraft's current speed.

Much of the current thinking concerning the airline/ATC delay problem is that it stems from the over scheduling by the airlines of too many aircraft into too few runways, see FIG. 3. While this may be true in part, it is also the case that the many apparently independent decisions that are made by an airline's staff (see FIG. 4 for an outline of the typical airline internal production processes) and various ATC controllers may significantly contribute to airline/ATC delay problems. And while many of these decisions are predictable, in the current art they have yet to be accounted for in the real time prediction of the trajectory of that aircraft.

The temporal variations in the arrival/departure times of aircraft into an airport can be quite significant. FIG. 5 shows for the Dallas-Ft. Worth Airport the times of arrival/departure at the airport's runways for the aircraft arriving during the thirty minute time period from 22:01 to 22:30. It can be seen that the numbers of aircraft arriving during the consecutive, five-minute intervals during this period were 12, 13, 6, 8, 6 and 5, respectively. Effectively, the ATC system deals with each aircraft as it arrives in the local area for landing. This leads to inconsistent aircraft flows, which, in turn, leads to inefficient use of the runways, which leads to delays that affect the predicted arrival time.

These delays are especially problematic since they are seen to be cumulative. FIG. 6 shows the percentage of aircraft arriving on time during consecutive one-hour periods throughout a typical day for all airlines and a number of U.S. airports. This on time arrival/departure performance is seen to deteriorate throughout the day. This supports the need for a long trajectory prediction as a twenty-minute delay can carry forward to all future flight segments planned for that aircraft throughout the day or, even worse, carry forward to other aircraft or even into the next day as, for example, crews switch aircraft or become illegal.

Another example of last minute changes to the flight's expected arrival/departure time stems from current aviation authority rules requiring different spacing between aircraft based on the size of the aircraft. Typical spacing between the arrivals of aircraft of the same size is three to four miles, or approximately one minute based on normal landing speeds. But if a small (Learjet, Cessna 172) or medium size aircraft (B737, MD80) is behind a heavy aircraft (B747, B767), this spacing distance is stretched out to five to six miles or one and a half to two minutes for safety considerations.

Thus, it can be seen that if a sequence of ten aircraft is such that a heavy aircraft alternates every other one with a small aircraft, the total distance of the arrival/departure sequence of aircraft to the runway (6+3+6+3+6+3+6+3+6+3) is 45 miles. But if this sequence develops to put all of the small aircraft in positions 1 through 5, and all of the heavy aircraft in slots 6 through 10, the total distance of the arrival/departure sequence of aircraft to the runway is only 35 miles (3+3+3+3+3+4+4+4+4+4) since the spacing between the aircraft is three or four miles. Since within the current art of arrival flow management the arrival sequence is allowed to develop randomly, the arrival/departure time can vary considerably from this one factor alone.

Unfortunately, to correct over capacity problems in the current art, the controller only has one option. They take the first over-capacity aircraft that arrives at the airport and move it backward in time. The second such aircraft is moved further back in time, the third, even further back, etc. Without a process in the current art to move aircraft forward in time or alter the arrival/departure sequence in real time, the controller has only one option—delays.

Further, the problem is compounded by the fact that traffic congestion is dealt with manually and piece-wise. Controllers and pilots solve traffic flow problems locally within small and somewhat disconnected airspace sectors without knowing the ripple effects propagating to other airspace sectors.

Clearly it is better to solve the problem in a coherent, coordinated and consistent manner, but this is not done in the current art. Yet to accomplish a coherent, coordinated and consistent solution, it is first necessary to have a comprehensive view of the airspace (including its capacity and ideally the capacity of all the interconnected assets such as gates, runways, customs, etc) that includes the trajectories and predictions of all arriving and departing flights as defined within the present invention. Further, it is clear that this is a complex problem that cannot be solved manually.

The current art of aircraft arrival/departure sequencing to an airport or other system resource that can effect the arrival prediction, can be broken down into seven distinct tools used by air traffic controllers, as applied in a first come, first serve basis, include:

Structured Dogleg Arrival/Departure Routes—The structured routings into an arrival/departure are typically designed with doglegs. The design of the dogleg is two straight segments joined by an angle of less than 180 degrees. The purpose of the dogleg is to allow controllers to cut the corner as necessary to maintain the correct spacing between arrival/departure aircraft.

Vectoring and Speed Control—If the actual spacing is more or less than the desired spacing, the controller can alter the speed of the aircraft to correct the spacing. Additionally, if the spacing is significantly smaller than desired, the controller can vector (turn) the aircraft off the route momentarily to increase the spacing. Given the last minute nature of these actions (within 100 mile of the airport), the outcome of such actions is limited.

The Approach Trombone—If too many aircraft arrive at a particular airport in a given period of time, the distance between the runway and base leg can be increased; see FIG. 7. This effectively lengthens the final approach and downwind legs allowing the controller to "store" or warehouse in-flight aircraft.

Miles in Trail—If the approach trombone can't handle the over demand for the runway asset, the ATC system begins spreading out the arrival/departure aircraft flows linearly. It does this by implementing "miles-in-trail" restrictions. Effectively, as the aircraft approach the airport for arrival/departure, instead of 5 to 10 miles between aircraft on the linear arrival/departure path, the controllers begin spacing the aircraft at twenty or more miles in trail, one behind the other; see FIG. 8.

Ground Holds—If the CAA separation authorities anticipate that the approach trombone and the miles-in-trail methods will not hold the aircraft overload, aircraft are held at their departure point and metered into the airspace system using assigned takeoff times.

Holding—If events happen too quickly, the controllers are forced to use airborne holding. Although this can be done anywhere in the system, this is usual done at one of the arrival/departures to an airport. Aircraft enter the "holding stack" from the enroute airspace at the top; see FIG. 9. Each holding pattern is approximately 10 to 20 miles long and 3 to 5 miles wide. As aircraft exit the bottom of the stack towards the airport, aircraft orbiting above are moved down 1,000 feet to the next level.

Reroute—If a section of airspace, enroute center, or airport is projected to become overloaded, the aviation authority occasionally reroutes individual aircraft over a longer lateral route to delay the aircraft's entry to the predicted congestion.

CAA's current air traffic handling procedures are seen to result in significant inefficiencies and delays, not fully accounted for in the arrival/departure predictions of the current art. For example, vectoring and speed control are usually accompanied with descents to a common altitude, which may change the aircraft's groundspeed, and therefore the actual arrival time. These actions taken by the controller are usually done in the last 20 to 30 minutes of flight, and while applications of the current art can recognize this effect in real time after the fact, they do not predict that these events will occur as is done in the present invention.

Thus, despite the above noted prior art, airlines/CAAs/airports/third parties continue to need more accurate methods and systems to better track and predict the trajectories of a plurality of aircraft into and out of a system resource, like an airport, or a set of system resources.

3. Objects and Advantages

There has been summarized above, rather broadly, the prior art that is related to the present invention in order that the context of the present invention may be better understood and appreciated. In this regard, it is instructive to also consider the objects and advantages of the present invention.

It is an object of the present invention to provide a method and system to better track and predict aircraft trajectories for a given number of hours into the future, with respect to a plurality of aircraft into and out of a specified system resource, like an airport, or set of resources, thereby overcoming the limitations of the prior art.

It is further object of the present invention that, although some steps of the present invention must be accomplished in order (i.e., one must collect the specified data before a trajectory can be built), other actions can be accomplished in any order (i.e. the long trajectory can be built prior to the ATC/weather/secondary factors are applied), while still other actions are accomplished in the order necessary.

It is another object of the present invention to present a method and system for the real time tracking and prediction of aircraft that takes into consideration a wider array of real time parameters and factors that heretofore were not considered. For example, such parameters and factors may include: aircraft related factors (e.g., speed, fuel, altitude, route, turbulence, winds, weather), ground services (gates, maintenance requirements, crew availability, etc.) and common asset availability (e.g., runways, airspace, Air Traffic Control (ATC) services).

It is another object of the present invention to provide a method and system that will enable the airspace users to better manage their aircraft by continuously and more accurately predicting the location of each aircraft along a forward looking time line x hours into the future—a long trajectory.

It is a further object of the present invention to provide a method and system that analyzes large amounts of real time information and other factors simultaneously, identifies system constraints and problems as early as possible, tracks the position of each aircraft, predicts multi segment arrival/departure times for each aircraft, and continuously monitors these predictions for changes.

It is still a further object of the present invention to temporally track and predict the arrival/departure times of aircraft into or out of a specific system resource in real time. Further, if ongoing events alter demand or capacity such that demand is above system capacity, it is then the object of the present invention to account for these problems in the arrival/departure predictions within the present invention.

Such objects are different from the current art, which typically tracks and predicts aircraft arrival times for a single flight, does not account for all of the outside factors that can alter the aircraft's trajectory, nor builds "long trajectories" necessary to more accurately predict multi segment arrival/departure times into the future.

These and other objects and advantages of the present invention will become readily apparent, as the invention is better understood by reference to the accompanying drawings and the detailed description that follows.

SUMMARY OF THE INVENTION

The present invention is generally directed towards mitigating the limitations and problems identified with prior methods used by airlines/CAAs/airports/third parties to track and predict aircraft trajectories. Specifically, the present invention is designed to more accurately track and predict multi-segment aircraft trajectories for up to x hours (typically 24) into the future.

In accordance with one preferred embodiment of the present invention, a process and method to temporally track and predict aircraft trajectories encompassing the arrival/departure times of a plurality of aircraft with respect to a specified system resource, based upon specified data and other operational factors pertaining to the aircraft and system resource, comprises the steps of (a) collecting and storing the specified data and operational factors, (b) processing, at an initial instant, the specified data that is applicable at that instant to the aircraft so as to predict an initial trajectory encompassing arrival/departure times for each aircraft, (c) upgrading these initial trajectory predictions for effects of (1) environmental factors (weather, turbulence), (2) actions of the ATC system (i.e., ATC system's response to the interaction of all of the aircraft trajectories and how they fit into the available airspace and runways), and (3) secondary assets (e.g., crew availability/legality, gate availability, maintenance requirements, along with other assets/labor availability necessary for the aircraft to continue on its trajectory), (d) temporally extrapolating these trajectories so that they are applicable for longer durations (i.e., long-trajectories which have predictions for multiple arrivals and departures for each of the individual aircraft within the system), (e) communicating trajectory predictions to all interested parties and (f) continuously monitoring all trajectories, and, as necessary, updating the predictions.

In accordance with another preferred embodiment of the present invention, a computer program product in a computer readable memory for temporally tracking and predicting aircraft trajectories encompassing the arrival/departure times of a plurality of aircraft with respect to a specified system resource, based upon specified data and other operational factors pertaining to the aircraft and system resource, comprises: (a) a means for collecting and storing the specified data and operational factors, (b) a means for processing, at an initial instant, the specified data that is applicable at that instant to the aircraft so as to predict an initial trajectory encompassing arrival/departure times for each of aircraft, (c) a means for upgrading these initial trajectory predictions for effects of (1) environmental factors (e.g., weather, turbulence), (2) actions of the ATC system (i.e., ATC system's response to the interaction of all of the aircraft trajectories and how they fit into the available airspace and runways), and (3) secondary assets (e.g., crew availability/legality, gate availability, maintenance requirements, along with other assets/labor availability necessary for the aircraft to continue on its trajectory), (d) a means for temporally extrapolating these trajectories so that they are applicable for longer durations (long-trajectories), (e) a means for communicating trajectory predictions to all interested parties and (f) a means for continuously monitoring all trajectories, and, as necessary, updating the predictions.

In accordance with another preferred embodiment of the present invention, a system, including a processor, memory, display and input device, to temporally track and predict aircraft trajectories encompassing the arrival/departure times of a plurality of aircraft with respect to a specified system resource, based upon specified data and other operational factors pertaining to the aircraft and system resource, comprises: (a) a means for collecting and storing the specified data and operational factors, (b) a means for processing, at an initial instant, the specified data that is applicable at that instant to the aircraft so as to predict an initial trajectory encompassing arrival/departure times for each of aircraft, (c) a means for upgrading these initial trajectory predictions for effects of (1) environmental factors (e.g., weather, turbulence), (2) actions of the ATC system (i.e., ATC system's response to the interaction of all of the aircraft trajectories and how they fit into the available airspace and runways), and (3) secondary assets (crew availability/legality, gate availability, maintenance requirements, along with other assets/labor availability necessary for the aircraft to continue on its trajectory), (d) a means for temporally extrapolating these trajectories so that they are applicable for longer durations (long-trajectories), (e) a means for communicating trajectory predictions to all interested parties and (f) a means for continuously monitoring all trajectories, and, as necessary, updating the predictions.

Thus, there has been summarized above, rather broadly, the present invention in order that the detailed description that follows may be better understood and appreciated. There are, of course, additional features of the invention that will be described hereinafter and which will form the subject matter of any eventual claims to this invention.

BRIEF DESCRIPTION OF THE DRAWINGS

FIG. 1 presents a depiction of a typical aircraft flight process.

FIG. 2 illustrates a typical arrival/departure paths from a busy airport.

FIG. 3 illustrates an aircraft scheduled arrival demand versus capacity at a typical hub airport. The graph is broken down into 15-minute blocks of time.

FIG. 4 illustrates a typical airline production process.

FIG. 5 illustrates an arrival/departure bank of aircraft at Dallas/Ft. Worth airport collected as part of NASA's CTAS project.

FIG. 6 illustrates the December 2000, on-time arrival/departure performance at sixteen specific airports for various one hour periods during the day.

FIG. 7 presents a depiction of the arrival/departure trombone method of sequencing aircraft.

FIG. 8 presents a depiction of the miles-in-trail method of sequencing aircraft.

FIG. 9 presents a depiction of the airborne holding method of sequencing aircraft.

FIG. 10 presents a flow diagram describing the method of the present invention.

FIGS. 11*a*–11*e* provides an illustration of the many of the factors that must be considered to more accurately predict arrival/departure times and build long trajectories.

FIG. 12 illustrates the various types of data and some of the computational steps that are used in the process of the present invention.

FIG. 13 illustrates the difference between an unaltered aircraft flow, an ATC altered flow of aircraft and a time sequenced aircraft flow.

FIG. 14 illustrates a preferred method and process to build a trajectory.

FIG. 15 illustrates a long-trajectory prediction (prior to departure from MSP) of a single aircraft from departure from MSP to ORD to RDU and then back to ORD. The vertical lines under each airport's name represent time lines.

DEFINITIONS

ACARS—ARINC Communications Addressing and Reporting System is a discreet data link system between the aircraft and ground personnel. This provides very basic email capability between the aircraft and a limited sets of operational data and personnel. Functionality from this data link source includes operational data, weather data, pilot to dispatcher communication, pilot to aviation authority communication, airport data, OOOI data, etc.

Aircraft Situational Data (ASD)—This an acronym for a real time data source (approximately 1 to 5 minute updates) provided by the world's aviation authorities, including the Federal Aviation Administration, comprising aircraft position and intent for the aircraft flying over the United States and beyond.

Aircraft Trajectory—The movement or usage of an aircraft defined as a position and time (past, present or future). For example, the trajectory of an aircraft is depicted as a position, time and intent. This trajectory can include in flight positions, as well as taxi positions, and even parking at a specified gate or parking spot.

Airline—a business entity engaged in the transportation of passengers, bags and cargo on an aircraft.

Airline Arrival Bank—A component of a hub airline's operation where numerous aircraft, owned by the hub airline, arrive at a specific airport (hub airport) within in a very short time frame.

Airline Departure Bank—A component of a hub aviation's operation where numerous aircraft, owned by the hub airline, depart from a specific airport (hub airport) within a very short time frame.

Airline Gate—An area or structure where aircraft owners/airlines park their aircraft for the purpose of loading and unloading passengers and cargo.

Air Traffic Control System (ATC)—A system to assure the safe separation of moving aircraft operated by an aviation regulatory authority. In numerous countries, this system is managed by the Civil Aviation Authority (CAA). In the United States the federal agency responsible for this task is the Federal Aviation Administration (FAA).

Arrival/Departure Times—Refers to the time an aircraft was, or will be at a certain trajectory. While the arrival/ departure time at the gate is commonly the main point of interest for most aviation entities and airline customers, the arrival/departure time referred to herein can refer to the arrival/departure time at or from any point along the aircraft's present or long trajectory.

Arrival/departure fix/Cornerpost (FIG. 2)—At larger airports, the aviation regulatory authorities have instituted structured arrival/departure points that force all arrival/departure aircraft over geographic points (typically four for arrivals and four for departures). These are typically 30 to 50 miles from the arrival/departure airport and are separated by approximately 90 degrees. The purpose of these arrival/departure points or cornerposts is so that the controllers can better sequence the aircraft, while keeping them separate from the other arrival/departure aircraft flows. In the future it may be possible to move these merge points closer to the airport, or eliminate them all together. As described herein, the arrival/departure cornerpost referred to herein will be one of the points where the aircraft merge. Additionally, besides an airport, as referred to herein, an arrival/departure fix/cornerpost can refer to entry/exit points to any system resource, e.g., a runway, an airport gate, a section of airspace, a CAA control sector, a section of the airport ramp, etc. Further, an arrival/departure fix/cornerpost can represent an arbitrary point in space where an aircraft is or will be at some past, present or future time.

Asset—To include assets such as aircraft, airports, runways, and airspace, flight jetway, gates, fuel trucks, lavatory trucks, and other labor assets necessary to operate all of the aviation assets.

Automatic Dependent Surveillance (ADS)—A data link surveillance system currently under development. This system, which is installed on the aircraft, captures the aircraft position from the onboard navigation system and then communicates it to the CAA/FAA, other aircraft, etc.

Aviation Authority—Also aviation regulatory authority. This is the agency responsible for aviation safety along with the separation of aircraft when they are moving. Typically, this is a government-controlled agency, but a recent trend is to privatize this function. In the US, this agency is the Federal Aviation Administration (FAA). In numerous other countries, it is referred to as the Civil Aviation Authority (CAA).

Block Time—The time from aircraft gate departure to aircraft gate arrival. This can block time (scheduled departure time to scheduled arrival/departure time as posted in the airline schedule) or actual block time (time difference between when the aircraft door is closed and the brakes are released at the departure station until the brakes are set and the door is open at the arrival station).

CAA—Civil Aviation Authority. As used herein is meant to refer to any aviation authority responsible for the safe separation of moving aircraft, including the FAA within the US.

Cooperative Decision-Making (CDM)—A program between FAA and the airlines wherein the airlines provide the FAA a more realistic real time schedule of their aircraft. For example if an airline cancels 20% of its flights into a hub because of bad weather, it would advise the FAA. In turn, the FAA compiles the data and redistributes it to all participating members.

Common Assets—Assets that must be utilized by the all airspace/airport/runway users and which are usually controlled by the aviation authority (e.g., CAA, FAA, airport). These assets (e.g., runways, ATC system, airspace, etc.) are not typically owned by any one airspace user.

CTAS—Center Tracon Automation System—This is a NASA developed set of tools (TMA, FAST, etc.) that seeks to temporally track and manage the flow of aircraft from approximately 150 miles from the airport to arrival/departure.

Federal Aviation Administration—The government agency responsible for the safe separation of aircraft while they are moving in the air or on the ground within the United States.

Figure of Merit (FOM)—A method of evaluating the accuracy of a piece of data, data set, calculation, etc. It also is a method to represent the confidence, i.e. degree of certainty, the system has in the trajectory and/or prediction.

Four-dimensional Path—The definition of the movement of an object in one or more of four dimensions—x, y, z and time.

Goal Function—a method or process of measurement of the degree of attainment for a set of specified goals. A method or process to evaluate the current scenario against a set of specified goals, generate various alternative scenarios, with these alternative scenarios, along with the current scenario then being assessed with the goal attainment assessment process to identify which of these alternative scenarios will yield the highest degree of attainment for a set of specified goals. The purpose of function is to find a solution that "better" the specified goals (as defined by the operator) than the present condition and determine if it is worth (as defined by the operator) changing to the "better" condition/solution. This is always true, whether it is the initial run or one generated by the monitoring system. In the case of the monitoring system (and this could even be set up for the initial condition/solution as well), it is triggered by some defined difference (as defined by the operator) between the how well the present condition meets the specified goals versus some "better" condition/solution found by the present invention. Once the Goal function finds a "better" condition/solution that it determines is worth changing to, a process translates said "better" condition/solution into some doable task and then communicates this to the interested parties, and then monitors the new current condition to determine if any "better" condition/solution can be found and is worth changing again.

Hub Airline—An airline operating strategy whereby passengers from various cities (spokes) are funneled to an interchange point (hub) and connect flight to various other cities. This allows the airlines to capture greater amounts of traffic flow to and from cities they serve, and offers smaller communities one-stop access to literally hundreds of nationwide and worldwide destinations.

IFR—Instrument Flight Rules. A set of flight rules wherein the pilot files a flight plan with the aviation authorities responsible for separation safety. Although this set of flight rules is based on instrument flying (e.g., the pilot references the aircraft instruments) when the pilot cannot see at night or in the clouds, the weather and the pilot's ability to see outside the aircraft are not a determining factors in IFR flying. When flying on a IFR flight plan, the aviation authority (e.g., ATC controller) is responsible for the separation of the aircraft when it moves.

Long-Trajectory—The ability to look beyond the current flight segment to build the trajectory of an aircraft or other aviation asset (i.e., gate) for x hours (typically 24) into the future. This forward looking, long-trajectory may include numerous flight segments for an aircraft, with the taxi time and the time the aircraft is parked at the gate included in this trajectory. For example, given an aircraft's current position and other factors, it is predicted to land at ORD at 08:45, be at the gate at 08:52, depart the gate at 09:35, takeoff at 09:47 and land at DCA at 11:20 and be at the DCA gate at 11:34. At each point along this long trajectory, numerous factors can influence and change the trajectory. The more accurately the present invention can predict these factors, the more accurately the prediction of each event along the long trajectory. Further, within the present invention, the long-trajectory is used to predict the location of an aircraft at any point x hours into the future.

OOOI—A specific aviation data set comprised of; when the aircraft departs the gate (Out), takes off (Off), lands (On), and arrives at the gate (In). These times are typically automatically sent to the airline via the ACARS data link, but could be collected in any number of ways.

PASSUR—A passive surveillance system usually installed at the operations centers at the hub airport by the hub airline. This proprietary device allows the airline's operational people on the ground to display the airborne aircraft in the vicinity (up to approximately 150 miles) of the airport where it is installed. This system has a local capability to predict landing times based on the current flow of aircraft, thus incorporating a small aspect of the ATC prediction within the present invention.

Strategic Tracking—The use of long range information (current time up to "x" hours into the future, where "x" is defined by the operator of the present invention, typically 24 hours) to determine demand and certain choke points in the airspace system along with other pertinent data as this information relates to the trajectory of each aircraft to better predict multi segment arrival/departures times for each aircraft.

System Resource—a resource like an airport, runway, gate, ramp area, or section of airspace, etc, that is used by all aircraft. A constrained system resource is one where demand for that resource exceeds capacity. This may be an airport with 70 aircraft that want to land in a single hour, with arrival/departure capacity of 50 aircraft per hour. Or it could be an airport with 2 aircraft wanting to land at the same exact time, with capacity of only 1 arrival/departure at a time. Or it could be a hole in a long line of thunderstorms that many aircraft want to utilize. Additionally, this can represent a group or set of system resources that can be tracked and predicted simultaneously. For example, an arrival/departure cornerpost, runaway and gate represent a set of system resources that can be tracked and predictions made as a combined set of resources to better predict the arrival/departure times of aircraft.

Tactical Tracking—The use of real time information (current time up to "n1" minutes into the future, where "n1" is defined by the operator of the present invention, typically 1 to 3 hours) to predict single segment arrival/departure times for each aircraft.

Trajectory—See aircraft trajectory and four-dimensional path above.

VFR—Visual Flight Rules. A set of flight rules wherein the pilot may or may not file a flight plan with the aviation authorities responsible for separation safety. This set of flight rules is based on visual flying (e.g., the pilot references visual cues outside the aircraft) and the pilot must be able to see and cannot fly in the clouds. When flying on a VFR flight plan, the pilot is responsible for the separation of the aircraft when it moves.

DESCRIPTION OF THE PREFERRED EMBODIMENT

Referring now to the drawings wherein are shown preferred embodiments and wherein like reference numerals designate like elements throughout, there is shown in the drawings the processes involved in the present invention. This process effectively tracks and predicts the temporal arrival/departure times of a plurality of aircraft into or out of an aviation system resource or set of resources.

For ease of understanding, the ensuing description is initially based on tracking, and predicting the temporal movement of a single aircraft arrival into a single system resource (e.g., an airport). The aircraft's arrival time is predicted based upon consideration of specified data, including the aircraft's present or initial position, the aircraft's flight performance capabilities, the capacity of the airport and arrival/departure paths, environmental factors, and predicted ATC actions and other secondary factors.

The present invention includes the following process steps, see FIG. 10:

The initial trajectory tracking (e.g., three spatial directions and time into the designated airport for the current leg of the aircraft's planned flight) step of collecting all of the pertinent data (1001) concerning the current position, status, flight plans, etc., of the aircraft of interest and the other system resources and assets with which the aircraft will interact, A first prediction step that inputs the aircraft's current position, flight path and status into an algorithm which builds an initial trajectory (1002) which predicts the aircraft's future position or usage and status for a given specifiable time, A second prediction step (1003*a*) that computes the effects of expected environmental factors (e.g., weather, turbulence) that how they will alter the initial predicted aircraft arrival/departure time and includes these effects so as to yield the aircraft's improved, or second predicted, trajectory, A third prediction step (1003*b*) that computes the effects of the expected ATC factors (arriving/departing aircraft, airport capacity versus demand and other airspace related issues) and how they will alter the predicted aircraft arrival/departure time. For example, this step might add thirty minutes to the second predicted arrival time due to the aircraft having to enter arrival trombone or be stacked for arrival, A fourth prediction step (1003*c*) that computes the effects of all of the expected additional, secondary elements necessary for the movement of the aircraft (e.g., crews, fuel, gates) and how they will alter the third predicted aircraft arrival/departure time. In some instances, the step will not actually alter the third prediction, but will instead set allowable time periods during which the third prediction must fall. For example, when the crew and gate are only available during the period 11:00–11:30 and the third prediction has yielded a delayed arrival time of 11:45. The availability of this information makes it possible for reactive steps to be taken which will try to remedy this situation.

A long-trajectory prediction step (1004) that utilizes the algorithms previously used in the initial through fourth prediction steps so as to extend the predicted trajectory to encompass the planned flight's other, future flight legs or segments, the aircraft's long- trajectory prediction encompassing the arrival/departure times for the aircraft and other assets (e.g., gates) for "x" hours into the future, An optional validation and approval step (1005) which entails an airline/CAA or other system operator validating the degree of certainty, practicality and feasibility of the aircraft's long-trajectory prediction, A system wide prediction step (1006) based on all of the prior predictions, calculations and constraints to identify the predicted position (i.e., gate arrival time) of each of the aircraft and other assets of the system at each instant over a duration of x hours into the future, A communication step (1007) which involves an airline/CAA or other system operator communicating the predicted aircraft trajectories and/or other predicted asset usage information to interested parties, and A closed loop monitoring step (1008) which involves continually monitoring the current state of the system aircraft and the factors which can affect them, and using this information to predict updated aircraft trajectories. If at anytime the actions or change in status of one of the aircraft or other system resource assets would significantly change the current aircraft trajectories beyond a specified threshold as determined by the operator, the system operator can be notified, or the system can automatically be triggered, to again seek to build new aircraft trajectories and predictions.

This method is seen to avoid the pitfall of predicting aircraft trajectories encompassing the arrival/departure based on the narrow view within the current art. While the present invention is capable of providing a linear (e.g., aircraft by aircraft) solution to the predicted aircraft trajectories for a plurality of aircraft approaching an airport, it is recognized that because of the interdependency of the aircraft flows, a multi-dimensional (predict the aircraft trajectories encompassing the arrival/departure times for the whole set of aircraft, airport assets, system s resources, etc.) prediction process provides more accurate arrival/departure times.

For the sake of brevity, only the aircraft movement aspects into an airport are described herein in detail. It should understood that the present invention works as well with the trajectories of aircraft into or out of any aviation system resource (e.g., airspace, runways, gates, ramps, etc.), along with the trajectory prediction and assessment of gates, crew and other airline assets. Further, only the operation of the present invention by a CAA is explained. It should be understood that any aviation entity (airline, military, $3^{rd}$ party, etc.) could operate the system, thus altering the data flow.

Since the implementation of the method of the present invention uses a multi-dimensional calculation that evaluates numerous parameters simultaneously, the standard, yes-no arrival/departure times chart is difficult to construct for the present invention. Therefore, a table has been included as FIG. 11*a*–FIG. 11*e* to better depict the parameters that can alter the aircraft's trajectory.

Parameter Lists 1 and 2 in this table are seen to involve a number of airline/user/pilot-defined parameters that contribute to determining an aircraft's arrival/departure time. Since it would be difficult for a CAA/airport to collect the necessary data to make these decisions, one embodiment of the present invention leaves the collection of this data to the airline/user/pilot. That said, it would then be incumbent on the airline/user/pilot to coordinate their available data to the operator of the present invention so that they can be used to develop a more accurate prediction of the arrival/departure times for a plurality of aircraft traffic into an airport.

In Parameter List 1 of FIG. 11*b*, and initially ignoring other possibly interfering factors such as the weather, other aircraft's trajectories, external constraints to an aircraft's trajectory, etc., upwards of twenty aircraft parameters (e.g., time specific flight's baggage off and the baggage of the new passengers onto the plane, time necessary to perform scheduled maintenance or special repairs for a specific plane) must be analyzed simultaneously to predict the arrival/departure time of an aircraft. This is quite different than current business practices within the aviation industry, which includes focusing arrival/departure predictions on a very limited data set (e.g., current position and speed, and possibly winds).

In Parameter List 2 of FIG. 11*c*, an airline's local facilities at the destination airport are evaluated for their ability to meet the needs and/or wants of the individual aircraft, while also considering their possible interactions with the other aircraft that are approaching the same airport. To predict the arrival/departure time of an aircraft, this step involves consideration of parameters such as: (i) the time period during which a gate will be available for a specific incoming flight, (ii) the time period to hold a flight to allow the optimum number of connecting passengers to make the departing flight, and (iii) the time period during which a ground crew will be available to service the plane.

Parameter List 3 of FIG. 11*d* shows the data that is compiled by the relevant aviation authority (e.g., airport's resource data, weather, and other data compiled by the aviation authority) and which must be combined with the elements in Parameter Lists 1 and 2 to provide a more accurate arrival/departure prediction for an aircraft trajectory.

For hub airports, this can be a daunting task as thirty to sixty of a single airline's aircraft (along with numerous aircraft from other airlines) are scheduled to arrive at the hub airport in a very short period of time. The aircraft then exchange passengers, are serviced and then take off again. The departing aircraft are also scheduled to takeoff in a very short period of time. Typical hub operations are one to one and a half hours in duration and are repeated eight to twelve times per day.

FIG. 12 illustrates the various types of data sets that are used in this prediction process, these include: air traffic control objectives, generalized surveillance, aircraft kinematics, communication and messages, airspace structure, airspace and runway availability, user requirements (if available), labor resources, aircraft characteristics, scheduled arrival and departure times, weather, gate availability, maintenance, other assets, and safety, operational and efficiency goals.

In the current art, as described above, the arrival/departure times of aircraft vary considerably which leads to random arrival flow distributions based on numerous independent decisions, which leads to wasted runway capacity, see FIG. 13. The present invention contributes to reducing wasted runway capacity by identifying and allowing potential arrival/departure bunching or wasted capacity to be detected early, typically one to three hours (or more) before arrival as shown in the difference between lines 1 or 2 and line 3 of FIG. 13.

As also discussed above, the order of the aircraft, or their sequencing, as they approach the airport can also affect a runway's arrival/departure capacity. The present invention, through a more system oriented prediction process, predicts the arrival sequence for a set of arrival aircraft into an airport. With this information, a CAA/airline can potentially alter the arrival sequence so as to maximize a runway's arrival/departure capacity; as found in the inventors Regular application Ser. No. 09/861,262, filed May 18, 2001 and entitled "Method And System For Aircraft Flow Management By Airlines/Aviation Authorities."

To provide a better understanding of how this trajectory building process may be performed, consider the following. An aircraft trajectory is a four dimensional representation (latitude, longitude, altitude as a function of time) of an aircraft's flight profile. This may be represented as a chronological listing of the aircraft's constant speed, great-arc segments (with altitude block). Various boundary crossings of these arc segments can then be identified with defined airspace boundaries (such as ATC control centers and sectors). Fix time estimation (FTE) techniques are then used to predict the time when these boundary crossing events on the various arc segments will occur (fix time estimation takes into account wind speed and it is accomplished by integrating the equations of motion for a given constant airspeed). These techniques involve assuming that the time when a "coordination fix" is reached by the flight is known, and then computing the time to the other fixes in both directions using the most up to date value of the flight's cruise speed (true airspeed, corrected for winds).

These boundary crossing event predictions are then upgraded by computationally including the effects of (a) environmental factors (weather, turbulence), (b) actions of the ATC system (i.e., ATC system's response to the interaction of all of the aircraft trajectories and how they fit into the available airspace and runways), and (c) secondary assets (e.g., crew availability/legality, gate availability, maintenance requirements, along with other assets/labor availability necessary for the aircraft to continue on its trajectory). The basic process is shown in the FIG. 14.

After the trajectories are built, the present invention can include a step that estimates the degree of certainty, feasibility and reliability of the predicted trajectories. The present invention can estimate the degree of certainty, feasibility and reliability of the trajectories based on an internal predetermined set of rules that assigns a Figure of Merit (FOM) to each trajectory.

For example, if an aircraft is only minutes from arrival/departure, the degree of certainty of the predicted arrival/departure time is very high. There is simply too little time for any action that could alter the arrival/departure time significantly. Conversely, if the aircraft has filed its flight plan (intent), but has yet to depart Los Angeles for Atlanta there are many actions or events that would alter the predicted arrival/departure time.

It is easily understood that the FOM for these predictions is a function of time. The earlier in time the prediction is made, the less reliability the prediction will be and thus the lower its FOM. The closer in time the aircraft is to arrival/departure, the higher the reliability of the prediction, and therefore the higher its FOM. Effectively, the FOM represents the confidence that one may reasonably have in the degree of certainty of the predicted arrival/departure times. Along with time, other factors in determining the FOM include validity of intent, available of wind/weather data, availability of information from the pilot, etc.

Finally, to better illustrate the differences between the present invention and the prior means used for managing an airport's air traffic, consider the following examples:

EXAMPLE 1

Updates to the arrival time for many airlines are currently based on the flight plan calculated prior to departure (sometimes hours in advance) and/or manual updates by the pilot. At a few airports, as the aircraft approaches the destination airport, the arrival time is further updated based on local conditions.

The present invention provides an improvement in the reliability of these predictions of the arrival time by better utilizing currently available data. For example, as an aircraft leaves the gate, many airlines utilize ACARS to automatically send a departure message from the aircraft to the airline. The present invention uses this information and analyzes the estimated departure demand at the runways (based on schedules, filed flight plans and other information), the distance from the gate to the departure runway, possible local airborne departure constraints again based on departure demand versus capacity, etc., so to more reliably predict the time when the aircraft will actually lift off the runway and begin its flight. It then combines this prediction with various in-flight variables (e.g., the predicted time enroute, weather, ATC actions) and landing constraints (e.g., estimated arrival demand versus capacity at the destination airport, the distance between the landing runway and the arrival gate and arrival gate availability) to calculate a predicted gate arrival time and to identify whether this arrival time will fit within any landing constraints imposed by other resources in the system. As the flight progresses to the destination, the present invention continuously updates and further refines the gate arrival time and identifies its compatibility with other system imposed constraints.

EXAMPLE 2

One of the unique elements of the present invention is the concept of long or multi-segment trajectories. This involves the consideration of many factors and allows the present invention to predict potential problems in a future segment of a flight prior to or several flight segments before the future problematic segment.

To better understand this concept, it is instructive to first work backward to determine why an assumed problem occurred (e.g., a late RDU departure on a flight going to ORD). In this example, the aircraft that is to fly RDU to ORD departed ORD late on its way to RDU and was delayed enroute by weather. Looking farther back in time, the ORD late departure was caused by a late departure and arrival of the aircraft from MSP to ORD. And the late MSP departure was caused by the late arrival of the crew the previous evening who needed adequate crew rest for safety reasons.

Turning this around to a forward looking prediction process, see FIG. 15, once the present invention receives and analyzes the data of the late arrival of the crew into MSP, it then calculates the necessary crew rest requirement, predicts the late MSP departure (1201—30 minutes) and ORD arrival (1202—25 minutes), the late ORD departure (1203—23 minutes), the enroute weather delay (1204—17 minutes) and RDU arrival (1205—36 minutes) and finally the late RDU departure (1206—42 minutes). At each step in this process, the present invention would also factor in numerous other factors that could affect the aircraft's trajectory, ATC actions (1207—9 minutes from RDU to ORD which could be caused by the departure demand at the runways, possible local airborne departure constraints again based on departure loads, possible enroute constraints, the arrival demand at the destination airport), the time enroute requirement, the distance between the landing runway and the arrival gate, arrival gate availability and weather throughout the movement of the flight.

Using the present invention, once an airline knows that the RDU departure is predicted to be late, it may act to mitigate this delay. For example, it could change the crews in MSP to a crew which has the required rest for the on time departure the next morning.

EXAMPLE 3

When weather at an airport is expected to deteriorate to the point such that the rate of arrival/departures is lowered, the aviation authorities will "ground hold" aircraft at their departure points. Because of rapidly changing conditions and the difficulty of communicating to numerous aircraft that are being held on the ground, it can happen that announced one to two hour delays can be seen to be unnecessary within fifteen minutes of their initial announcement. Also, because of various uncertainties, it may happen that by the time the aircraft arrives at its destination, the constraint to the airport's arrival/departure rate is long since past and the aircraft is sped up for arrival/departure. An example of this scenario occurs when a rapidly moving thunderstorm clears the airport hours before the aircraft is scheduled to land.

The present invention helps avoid such needless "ground holds" by continually calculating arrival/departure times based on a large set of parameters, including the predicted changing weather conditions.

EXAMPLE 4

Numerous aviation delays are caused by the unavailability of an arrival/departure gate or parking spot. Current airline/airport practices typically assign gates either too early (e.g., months in advance) and only make modifications after a problem develops, or too late (e.g., when the aircraft lands). In one embodiment of the present invention, gate availability, as provided by the airline/airport, is integrated into the current arrival/departure prediction. By integrating the real time gate availability into the tracking prediction of the present invention, it becomes possible to easily identify those situations in which the lack of properly timed gate availability could adversely affect an aircraft's arrival time. This knowledge allows many people in the system to possibly react so as to avoid such predicted delays.

EXAMPLE 5

Given the increased reliability of predicted aircraft arrival/departure times and the identification of unworkable constraints imposed by system resources, the process of the present invention helps the airlines/users/pilots to more efficiently sequence the ground support assets such as gates, fueling, maintenance, flight crews, etc.

While this optimization process can be done manually, an automated system encompassing a multidimensional Function, as found in the inventors' Regular application Ser. No. 09/549074, would more rapidly provide a more accurate global solution to the arrival/departure prediction thus allowing for the improvement of the current operation at a reduced cost.

EXAMPLE 6

Some trajectories will actually never show an arrival at the intended destination. For example, if while the aircraft was in flight and the pilot accepted or was given a flight path that exceeded the parameters of the aircraft (i.e., not enough fuel), the pilot/airline/operator could be notified that the trajectory was invalid.

Take the example of a flight into ORD when there is very bad weather and the arrival landing capacity of the airport drops to 30 aircraft an hour from a normal arrival landing rate of 110 aircraft an hour. Now it can be seen that if an aircraft is predicted to be number 50 in line as it approaches the airport, it must hold for just under 2 hours. Now if the data is supplied to the present invention that the aircraft only has fuel to hold for 45 minutes, it is clear that, absence re-sequencing the arrival flow, the aircraft must divert to another airport.

In the current art, the aircraft would enter holding, and after 35 to 40 minutes, the pilot realizing that there is not enough fuel to hold any longer, will divert to another airport. Using the present invention, prior to approaching the airport and entering the holding stack, the pilot/airline would see the trajectory showing that there was not enough fuel for normal sequencing into the destination, and as such, the trajectory prediction in the present invention could show that the aircraft had no possible way to land at the intended destination (i.e., the display might show the word "Divert" predicted landing time or the present invention could show the trajectory extending to the declared diversion airport as declared in the flight plan sent to the CAA prior to departure). The point is that the information that the aircraft had zero probability of landing at the original destination is calculated and provided to the operator/airline/pilot.

Although the foregoing disclosure relates to preferred embodiments of the invention, it is understood that these details have been given for the purposes of clarification only. Various changes and modifications of the invention will be apparent, to one having ordinary skill in the art, without departing from the spirit and scope of the invention as hereinafter set forth in the claims.

We claim:

1. A method for predicting the trajectory of an aircraft based upon specified input data regarding said aircraft and the resources with which said aircraft interacts, said method comprising the steps of:

collecting and storing said specified data, processing, at any given initial instant, said data pertaining to said aircraft's current position and planned flight path so as to predict an initial aircraft trajectory, calculating a first revised aircraft trajectory that includes revisions to said initial aircraft trajectory due to the effects of said specified data that pertain to environmental factors, calculating a second revised aircraft trajectory that includes revisions to said first, revised aircraft trajectory due to the effects of said specified data that pertain to Air Traffic Control factors, and calculating a third revised aircraft trajectory that includes revisions to said second revised aircraft trajectory due to the effects of said specified data that pertains to said resources with which said aircraft interacts.

2. A method as recited in claim 1, wherein said aircraft is one of a group of aircraft that share common resources, and wherein said method further comprises the step of:

collecting and storing specified data that pertains to each of said other aircraft in said group of aircraft, processing said data pertaining to each of said aircraft in said group so as to predict an initial trajectory for each of said aircraft in said group, calculating the loads that said predicted trajectories of said group of aircraft will impose on said shared resources, and calculating a fourth revised aircraft trajectory that includes revisions to said third revised aircraft trajectory which are made to allow said shared resources to accommodate said loads predicted to be imposed by said predicted trajectories of said group of aircraft.

3. A method as recited in claim 1, further comprising the step of:

communicating said predicted trajectories to an operator selected from the group consisting of those operators which operate said aircraft and resources.

4. A method as recited in claim 2, further comprising the step of:

communicating said predicted trajectories to an operator selected from the group consisting of those operators which operate said aircraft and resources.

5. A method as recited in claim 1, wherein said specified data that pertains to said environmental factors is selected from the group consisting of weather and turbulence data.

6. A method as recited in claim 1, wherein said specified data that pertains to said Air Traffic Control factors is selected from the group consisting of data pertaining to demand versus capacity considerations for airport resources.

7. A method as recited in claim 1, wherein said specified data that pertains to the resources with which said aircraft interacts is selected from the group consisting of crew availability data, fuel availability data, gate availability data, time requirements for baggage loading and unloading, time requirements for aircraft servicing, time requirements for aircraft maintenance, and time period required to allow a specified number of connecting passengers to make necessary connections.

8. A computer program product in a computer readable memory for predicting the trajectory of an aircraft based upon specified input data regarding said aircraft and the resources with which said aircraft interacts, said computer program comprising:

a means for collecting and storing said specified data, a means for processing, at any given initial instant, said data pertaining to said aircraft's current position and planned flight path so as to predict an initial aircraft trajectory, a means for calculating a first revised aircraft trajectory that includes revisions to said initial aircraft trajectory due to the effects of said specified data that pertain to environmental factors, a means for calculating a second revised aircraft trajectory that includes revisions to said first, revised aircraft trajectory due to the effects of said specified data that pertain to Air Traffic Control factors, and a means for calculating a third revised aircraft trajectory that includes revisions to said second revised aircraft trajectory due to the effects of said specified data that pertains to said resources with which said aircraft interacts.

9. A computer program product as recited in claim 8, wherein said aircraft is one of a group of aircraft that share common resources, and wherein said product further comprising:

a means for collecting and storing specified data that pertains to each of said other aircraft in said group of aircraft, a means for processing said data pertaining to each of said aircraft in said group so as to predict an initial trajectory for each of said aircraft in said group, a means for calculating the loads that said predicted trajectories of said group of aircraft will impose on said shared resources, and a means for calculating a fourth revised aircraft trajectory that includes revisions to said third revised aircraft trajectory which are made to allow said shared resources to accommodate said loads predicted to be imposed by said predicted trajectories of said group of aircraft.

10. A computer program product as recited in claim 8, further comprising:

a means for communicating said predicted trajectories to an operator selected from the group consisting of those operators which operate said aircraft and resources.

11. A computer program product as recited in claim 9, further comprising:

a means for communicating said predicted trajectories to an operator selected from the group consisting of those operators which operate said aircraft and resources.

12. A computed program product as recited in claim 8, wherein said specified data that pertains to said environmental factors is selected from the group consisting of weather and turbulence data.

13. A computed program product as recited in claim 8, wherein said specified data that pertains to said Air Traffic Control factors is selected from the group consisting of data pertaining to demand versus capacity considerations for airport resources.

14. A computed program product as recited in claim 8, wherein said specified data that pertains to the resources with which said aircraft interacts is selected from the group consisting of crew availability data, fuel availability data, gate availability data, time requirements for baggage loading and unloading, time requirements for aircraft servicing, time requirements for aircraft maintenance, and time period required to allow a specified number of connecting passengers to make necessary connections.

15. A system, including a processor, memory, display and input device, for predicting the trajectory of an aircraft based upon specified input data regarding said aircraft and the resources with which said aircraft interacts, said system comprising:

a means for collecting and storing said specified data, a means for processing, at any given initial instant, said data pertaining to said aircraft's current position and planned flight path so as to predict an initial aircraft trajectory, a means for calculating a first revised aircraft trajectory that includes revisions to said initial aircraft trajectory due to the effects of said specified data that pertain to environmental factors, a means for calculating a second revised aircraft trajectory that includes revisions to said first, revised aircraft trajectory due to the effects of said specified data that pertain to Air Traffic Control factors, and a means for calculating a third revised aircraft trajectory that includes revisions to said second revised aircraft trajectory due to the effects of said specified data that pertains to said resources with which said aircraft interacts.

16. A system as recited in claim 15, wherein said aircraft is one of a group of aircraft that share common resources, and wherein said system further comprising:

a means for collecting and storing specified data that pertains to each of said other aircraft in said group of aircraft, a means for processing said data pertaining to each of said aircraft in said group so as to predict an initial trajectory for each of said aircraft in said group, a means for calculating the loads that said predicted trajectories of said group of aircraft will impose on said shared resources, and a means for calculating a fourth revised aircraft trajectory that includes revisions to said third revised aircraft trajectory which are made to allow said shared resources to accommodate said loads predicted to be imposed by said predicted trajectories of said group of aircraft.

17. A system as recited in claim 15, further comprising:

a means for communicating said predicted trajectories to an operator selected from the group consisting of those operators which operate said aircraft and resources.

18. A system as recited in claim 16, further comprising:

a means for communicating said predicted trajectories to an operator selected from the group consisting of those operators which operate said aircraft and resources.

19. A system as recited in claim 15, wherein said specified data that pertains to said environmental factors is selected from the group consisting of weather and turbulence data.

20. A system as recited in claim 15, wherein said specified data that pertains to said Air Traffic Control factors is selected from the group consisting of data pertaining to demand versus capacity considerations for airport resources.

21. A system as recited in claim 15, wherein said specified data that pertains to the resources with which said aircraft interacts is selected from the group consisting of crew availability data, fuel availability data, gate availability data, time requirements for baggage loading and unloading, time requirements for aircraft servicing, time requirements for aircraft maintenance, and time period required to allow a specified number of connecting passengers to make necessary connections.

* * * * *